US009372439B2

(12) United States Patent
Kubo et al.

(10) Patent No.: US 9,372,439 B2
(45) Date of Patent: Jun. 21, 2016

(54) DEVELOPING DEVICE AND IMAGE FORMING APPARATUS

(71) Applicant: CANON KABUSHIKI KAISHA, Tokyo (JP)

(72) Inventors: Kenta Kubo, Kamakura (JP); Tatsuya Tada, Yokohama (JP); Satoru Yamanaka, Kawasaki (JP); Hideaki Okamoto, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/613,608

(22) Filed: Feb. 4, 2015

(65) Prior Publication Data

US 2015/0227078 A1 Aug. 13, 2015

(30) Foreign Application Priority Data

Feb. 12, 2014 (JP) ..... 2014-024649

(51) Int. Cl.
*G03G 15/08* (2006.01)
*G03G 15/09* (2006.01)

(52) U.S. Cl.
CPC ..... *G03G 15/0865* (2013.01); *G03G 15/0808* (2013.01); *G03G 15/09* (2013.01)

(58) Field of Classification Search
CPC ..... G03G 15/0921; G03G 15/0928; G03G 15/0942; G03G 15/0907; G03G 15/09
See application file for complete search history.

(56) References Cited

U.S. PATENT DOCUMENTS

| | | | | |
|---|---|---|---|---|
| 5,153,376 | A * | 10/1992 | Tomita | 399/276 |
| 7,403,736 | B2 | 7/2008 | Fujita et al. | |
| 7,546,066 | B2 | 6/2009 | Fujita et al. | |
| 2003/0170050 | A1 * | 9/2003 | Terai | 399/267 |
| 2005/0069348 | A1 | 3/2005 | Fujita et al. | |
| 2007/0177908 | A1 * | 8/2007 | Aruga et al. | 399/286 |

(Continued)

FOREIGN PATENT DOCUMENTS

| | | | |
|---|---|---|---|
| CN | 103869667 | A | 6/2014 |
| EP | 2 743 776 | A2 | 6/2014 |

(Continued)

OTHER PUBLICATIONS

European Search Report dated Jun. 18, 2015, in related European Patent Application No. 15154690.0.

*Primary Examiner* — David Gray
*Assistant Examiner* — Sevan A Aydin
(74) *Attorney, Agent, or Firm* — Fitzpatrick, Cella, Harper & Scinto

(57) ABSTRACT

A developing device includes a developing member, a toner supplying member, and a carrier recovering member configured to recover magnetic carrier particles from the toner supplying member. An outer surface of the toner supplying member includes a plurality of protrusion portions with a regular interval between adjacent protrusion portions. The regular interval is equal to or larger than a particle diameter of a toner particle having an average particle diameter from among the particle diameters of the toner particles and smaller than a carrier particle diameter of a magnetic carrier particle having an average particle diameter from among the particle diameters of the magnetic carrier particles. The protrusion portions protrude from the remainder of the outer surface of the toner supplying member with a height that is smaller than the average particle diameter of the toner particles.

17 Claims, 28 Drawing Sheets

(56) References Cited

U.S. PATENT DOCUMENTS

| | | | | |
|---|---|---|---|---|
| 2008/0080905 | A1* | 4/2008 | Hirota et al. | 399/270 |
| 2008/0247771 | A1 | 10/2008 | Fujita et al. | |
| 2009/0175659 | A1* | 7/2009 | Sheen | 399/256 |
| 2009/0285597 | A1* | 11/2009 | Uetake et al. | 399/100 |
| 2009/0317142 | A1* | 12/2009 | Takai | 399/270 |
| 2014/0023408 | A1* | 1/2014 | Kato et al. | 399/269 |
| 2014/0161493 | A1* | 6/2014 | Kubo et al. | 399/272 |

FOREIGN PATENT DOCUMENTS

| | | | | | |
|---|---|---|---|---|---|
| JP | H09-211970 | A | | 8/1997 | |
| JP | H10-198161 | A | | 7/1998 | |
| JP | H11-038749 | A | | 2/1999 | |
| JP | 2004020581 | A | * | 1/2004 | G03G 15/08 |
| JP | 3536598 | B2 | | 6/2004 | |
| JP | 2009-008834 | A | | 1/2009 | |
| JP | 2014-115518 | A | | 6/2014 | |

* cited by examiner

ROTATIONAL DIRECTION OF DEVELOPING ROLL

DEVELOPING DEVICE AND IMAGE FORMING APPARATUS

BACKGROUND OF THE INVENTION

1. Field of the Invention

The present invention relates to an image forming apparatus such as a copying machine, a printer, or a facsimile using an electrophotographic system and a developing device used for the image forming apparatus.

2. Description of the Related Art

As a dry-type developing system applied to an electrophotographic system, a one-component developing system using only a toner and a two-component developing system using a developer containing a toner and a magnetic carrier are known.

In the one-component developing system, since there is no magnetic carrier, an electrostatic image of an image bearing member is not disturbed by a magnetic brush formed from a magnetic carrier, and the system is suitable for obtaining a high-quality image. However, in the one-component developing system, it is difficult to stably provide charges to the toner and there is a problem in the stability of the image quality. In addition, since there is no medium for transporting the toner, such as a magnetic carrier, it is difficult to exert a uniform transport force to the toner, and a mechanical load to the toner is easily increased during transporting or the like. Therefore, degradation in the stability of the image quality easily occurs due to the deterioration of the toner.

On the other hand, in the two-component developing system, although there is a problem in the image quality, since the toner is easily provided with charges and the load to the toner is small, the two-component developing system has a feature in that the stability of the image quality is high.

As a system of coping with the problems of the above-described two developing systems, there is known a hybrid developing system disclosed in, for example, Japanese Patent Laid-Open No. 9-211970. In this system, an image is formed by applying a transporting bias between a transporting roll (developer carrying member) which carries two-component developer and a developing roll (toner carrying member), coating the developing roll with a toner layer, and developing an electrostatic image of a photosensitive member (image bearing member) by using the toner.

However, it is known that, in the hybrid developing system, it is difficult to coat the developing roll with a stable toner layer for a long term. In the hybrid developing system, the developing roll is coated with the toner having a predetermined charge amount (Q/S) so that a potential difference ΔV generated by the above-described transporting bias is filled between the transporting roll and the developing roll. In this case, there is a relationship where ΔV and the charge amount Q/S of the toner per unit area to be coated are proportional to each other. In addition, Q/S is a product of the mass (M/S) of the toner involved with the coat per unit area and the charge amount (Q/M) per unit mass of the toner.

Therefore, the following equation is obtained.

$$\Delta V \propto Q/S = (M/S) \times (Q/M) \qquad \text{Equation (1)}$$

In other words, in the hybrid developing system, the mass (M/S) of the toner involved with the coat per unit area is determined based on the potential difference (ΔV) and the charge amount (Q/M) per unit mass of the toner. Therefore, the hybrid developing system has a problem in that, if the charging amount of the toner is changed, the toner amount involved with the coat is varied according to the change.

With respect to this problem, for example, Japanese Patent Laid-Open No. 2009-8834 discloses a configuration of measuring a thickness of a toner layer on a developing roll by using a toner layer thickness sensing member when coating the developing roll with the toner layer. In addition, the patent document also discloses a configuration of controlling the thickness of the toner layer on the developing roll to be a predetermined layer thickness by changing a transport bias between the developing roll and a magnetic roll (developer carrying member) or the number of rotations of the developing roll and the magnetic roll based on the thickness of the toner layer.

However, in the configuration, since a toner density sensor or a surface potential sensor is used as the toner layer thickness sensing member, the size of the device becomes large, or the cost is increased. In addition, even in the case of performing control by using a sensing member, if the transporting bias or the number of rotations of the developing roll is changed, since the developing conditions between the developing roll and the photosensitive member in the downstream also needs to be controlled simultaneously, the control becomes complicated. As a result, there is a problem in that it is difficult to achieve the original purpose of stabilizing the toner amount on the photosensitive member.

Therefore, as a developing system of coating a stable toner layer, for example, Japanese Patent Laid-Open No. 10-198161 discloses a configuration of using a rotatable regulating sleeve (developer regulating member) which is arranged to be separated by a certain interval from a developing roll. As a result, the toner is stably provided with charges by a carrier, so that the developing roll can be coated with a toner layer without a decrease in output image density or scattering of the toner. The developing device 120 is configured to include a developer container 121 which contains a developer 110 including a toner and a magnetic carrier.

Hereinafter, the developing device 120 will be described with reference to FIG. 22.

A developing roll 122, which is rotatable in the arrow direction of FIG. 22, and a carrier recovering member 123, which is separated by a certain distance above the developing roll 122, are arranged in an aperture of the developer container 121 which is formed at a position where the developer container faces the photosensitive member 101. The carrier recovering member 123 is configured to include a regulating sleeve 231 which is a non-magnetic member and a permanent magnet 232 which is arranged to be fixed inside thereof, and the regulating sleeve 231 is rotatably carried in the same direction as the rotational direction (arrow direction of FIG. 22) of the developing roll 122. In addition, a transporting member 124 which stirs the developer in the developer container 121 and supplies the developer to the developing roll 122 through the rotation (arrow direction of FIG. 22) is installed in the developer container 121.

Next, the coating of the toner layer on the developing roll 122 in the developing device 120 will be described.

The developer 110 in the developer container 121 is stirred and supplied to the developing roll 122 simultaneously by the transporting member 124. The to-be-supplied developer 110 is carried by the developing roll 122 which is magnetized by exertion of a magnetic force of a permanent magnet 232 in the regulating sleeve 231 to be transported and is regulated in the developer regulation region G.

FIG. 23 is an enlarged diagram of the developer regulation region G.

The magnetic carrier in the developer, restrained by the magnetic field in the developer regulation region G, is restrained by the magnetic force of the permanent magnet 232. Since regulating sleeve 231 is rotated in the arrow direction of the FIG. 23, the magnetic carrier has a transporting force exerted on it in the direction (direction A of FIG. 23) where the magnetic carrier is to be returned to the developer container 121 according to the rotation. Therefore, since the magnetic carrier is restrained in the developer regulation region G, the magnetic carrier is sequentially returned to the developer container 121 by the transporting force from the regulating sleeve 231 and the magnetic carrier does not leak out to the developing portion facing the photosensitive member 101.

On the other hand, the non-magnetic toner 111 in the developer in the developer regulation region G is not restrained by the magnetic field in the developer regulation region G. In addition, the non-magnetic toner 111 is adhered to the developing roll 122 by a reflection force generated by the charges provided by frictional charging between the magnetic carrier and the surface of the developing roll 122. Therefore, the non-magnetic toner 111 has a transport force exerted on it in the rotational direction (direction B of FIG. 23) of the developing roll 122 and according to the rotation of the developing roll 122 is caused to pass through the developer particles in the developer regulation region G to coat the developing roll 122.

As described above, the developing roll 122 may be coated with only the non-magnetic toner provided with sufficient charges without leakage of the magnetic carrier in the developing portion. According to the configuration disclosed in Japanese Patent Laid-Open No. 10-198161, since a force exerted on the toner which can be physically in contact with the developing roll is used, the phenomenon observed in the hybrid developing system that the toner amount involved with the coating is rapidly changed due to the change in charge amount (Q/M) of the toner does not occur.

In this manner, in the case where the charge amount of the toner is decreased, in the device of the hybrid developing system, the toner amount involved with the coat is increased. However, in the device disclosed in Japanese Patent Laid-Open No. 10-198161, since the increase in toner amount involved with the coat is suppressed, the change of the image density caused by the increase in toner amount can be suppressed.

However, it is found out from a result of detailed examination by the inventors of the present invention that, even in the developing device disclosed in Japanese Patent Laid-Open No. 10-198161, it is necessary to further suppress the change of the image density and to further improve image uniformity.

FIG. 24 is a conceptual diagram illustrating a toner layer obtained by the developing device 120 where the developing roll is coated with the toner layer. Black portions represent portions of the coated toner layer, and white portions represent areas which are not coated with the toner. As illustrated in FIG. 24, the areas which are not coated with the toner irregularly exist substantially in parallel to the rotational direction of the developing roll, and the toner density on the developing roll is non-uniform. In this manner, if the coating layer by the toner is formed non-uniformly on the developing roll, the image density is easily decreased. This is because the area of the white sheet portion where the sheet cannot be coated with the toner is increased during fixing, so that the image density is rapidly decreased.

On the other hand, more toner can be supplied to the photosensitive member by adjusting circumferential velocities of the developing roll and the photosensitive member, so that the image density can be increased. More specifically, in the case where the developing roll and the photosensitive member are rotated in the same direction in the facing portion, the increase of the image density can be achieved by allowing the circumferential velocity of the developing roll to be higher than that of the photosensitive member or by allowing the rotational directions of the developing roll and the photosensitive member to be reverse to each other in the facing portion. However, although a desired image density is obtained in this manner, as illustrated in FIG. 25B, only an image where the in-plane density irregularity is conspicuous and the image uniformity is low is obtained. In addition, in terms of reduction of energy consumption, it is required to output a desired image with a smaller toner amount. However, it denotes that more toner than required is consumed.

FIG. 25A is a schematic diagram illustrating the case where the electrostatic image on the photosensitive member is ideally developed with the toner. In addition, FIG. 25B is a schematic diagram illustrating the case where the image density is obtained by the above-described method.

In FIG. 25A, a toner image having a high uniformity can be obtained with a small toner amount. However, in FIG. 25B, the toner amount is large, and a toner image has a low uniformity.

It has been found out from a result of detailed examination by the inventors of the present invention that the reasons for this phenomenon can be described by models described below. This will be described with reference to FIG. 26.

FIG. 26 illustrates a state where the developer 110, which is transported in the rotational direction h of the developing roll 122 constitutes a magnetic brush by a magnetic force in the developer regulation region G to be restrained in the carrier recovering member 123 and is transported in the rotational direction j of the carrier recovering member 123. In the actual case, a larger number of the developer particles than shown in FIG. 26 exist as the magnetic brush.

In the process where the developer 110 is transported on the developing roll 122, the toner 111 of the developer 110 is charged by being in contact with the developing roll 122. At this time, the toner 111 is separated from the magnetic carrier 112 and is adhered to the developing roll 122.

On the other hand, as described above, the developer 110 which is restrained by the carrier recovering member 123 is transported in the rotational direction j (from the downstream side in the rotational direction h). Since the toner 111 has already been consumed (removed) from the developer 110 at the upstream side in the rotational direction j, the magnetic carrier 112 in the developer 110 has a capability of recovering the toner. Therefore, if the developer 110 transported in the rotational direction j of the carrier recovering member 123 is in contact with the toner 111 adhered to the developing roll 122, the toner 111 is recovered by the magnetic carrier 112 to be returned to the developer container 121.

FIGS. 27A and 27B are schematic diagrams illustrating a state where the toner 111 attached on the developing roll 122 is recovered by the magnetic carrier 112 of the developer 110.

If the developer 110 collides with the toner 111 on the developing roll 122 (FIG. 27A), a couple of forces are exerted on the toner 111, so that the toner is rotated on the developing roll 122 (FIG. 27B). Therefore, the adhesion force between the toner and the developing roll is decreased. At this time, since the magnetic carrier 112 is charged corresponding to the charges of the consumed toner with the opposite-polarity, the toner which coats the developing roll is scraped off by the magnetic carrier 112 while passing through the developer regulation region G. It is found out that, in this manner, since a trace of scraping by the magnetic carrier easily occurs in the transporting direction of the developer 110, that is, in the direction substantially parallel to the rotational direction of, mainly, the developing roll or the carrier recovering member, it is not possible to form a uniform coating of a toner layer on the developing roll.

SUMMARY OF THE INVENTION

The present invention provides a developing device and an image forming apparatus capable of obtaining a desired density even with a smaller toner amount and of obtaining a high-density toner image having good image uniformity.

According to an aspect of the present invention, there is provided a developing device, for developing an electrostatic image formed on an image bearing member by a developer containing non-magnetic toner particles and magnetic carrier particles, including a toner carrying member for carrying toner particles which are to be supplied to the image bearing member, a toner supplying member for transporting the toner particles to the toner carrying member and supplying the toner particles to the toner carrying member at a toner supplying portion, a developer supplying portion for supplying the developer to the toner supplying member, and a carrier recovering member for recovering developer from the developer which has been supplied to the toner supplying member, wherein an outer surface of the toner supplying member includes a plurality of protrusion portions which extend in a direction intersecting a toner transporting direction, wherein the plurality of protrusion portions are configured such that a toner particle having average particle diameter can contact an inside portion formed between two tops of neighboring protrusion portions and a magnetic carrier particle having average particle diameter cannot contact the inside portion, and wherein the height of the tops of the protrusion portions is smaller than the average particle diameter of the toner, and wherein the toner supplying member and the toner carrying member are movable so as to have a relative velocity difference in the toner supplying portion.

In the present invention, the protrusion portions are arranged on an outer layer surface of the toner supplying member, the interval between the adjacent protrusion portions is set to be equal to or larger than the toner particle diameter and smaller than the carrier particle diameter, and the height of the protrusion portions is set to be equal to or smaller than the toner particle diameter, so that it is possible to uniformly coat the toner supplying member with a single layer of the toner. In addition, it is possible to form a high-density coat on the toner carrying member by an arbitrary toner amount in a range of from a single layer to multiple layers. Therefore, it is possible to provide a developing device and an image forming apparatus capable of developing a uniform, high-density toner image on the image bearing member.

Further features of the present invention will become apparent from the following description of exemplary embodiments with reference to the attached drawings.

BRIEF DESCRIPTION OF THE DRAWINGS

FIG. 3A is a schematic diagram illustrating a structure of protrusion portions of the toner supplying member, and FIG. 3B is schematic cross-sectional diagram thereof.

FIG. 25A illustrates the case where ideal developing is performed, and FIG. 25B illustrates the case where the developing is performed by adjusting circumferential velocities of the developing roll and the photosensitive member.

DESCRIPTION OF THE EMBODIMENTS

In order to develop a high-density toner image on an image bearing member, it is very important to implement a coat having a high toner density on a toner carrying member independently of developing conditions. Herein, the developing conditions represent, for example, contact/non-contact between a photosensitive member and a toner carrying member, DC/(DC+AC) of a developing bias applied to the toner carrying member and the image bearing member, and the like. A developing device according to the present invention is capable of coating the toner carrying member with toners at a high density in a range of from a single layer to multiple layers and capable of developing a high-density toner image on the image bearing member even in various developing conditions.

Hereinafter, embodiments of the developing device according to the present invention will be described in detail with reference to the drawings.

<Configuration of Image Forming Apparatus>

Figure 1:
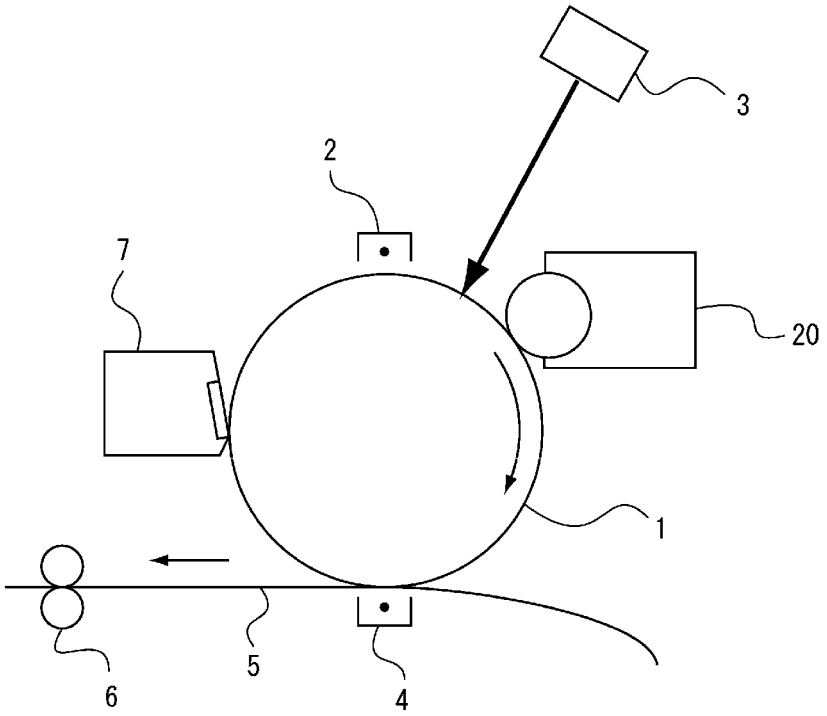
FIG. 1 is a schematic diagram illustrating an image forming apparatus using a developing device according to the present invention.

FIG. 1 is a schematic diagram illustrating an image forming apparatus of the embodiment using the developing device according to the present invention.

Although the present invention is described to be implemented as an image forming apparatus using electrophotographic system illustrated in FIG. 1, dimensions, materials, shapes, relative arrangement, or the like described in the embodiment are not intended to limit the scope of the present invention.

In the image forming apparatus using the electrophotographic system of FIG. 1, a drum-like electrophotographic photosensitive member 1 configured by applying a photoconductive layer on a conductive substrate as an image bearing member which retains an electrostatic image is rotatably installed, and the photosensitive member 1 is uniformly charged by a charger 2. Next, the electrostatic image is formed through exposing based on an information signal, for example, by a light-emitting element 3 such as a laser and is developed by a developing device 20 using a developer containing a non-magnetic toner and a magnetic carrier. Next, the developed image is transferred to a transfer sheet 5 by a transfer charger 4 and is fixed on the transfer sheet by a fixing device 6. In addition, a non-magnetic toner which is not transferred but remains on the photosensitive member 1 is removed from the photosensitive member 1 by a cleaning device 7.

First Embodiment

Figure 2:
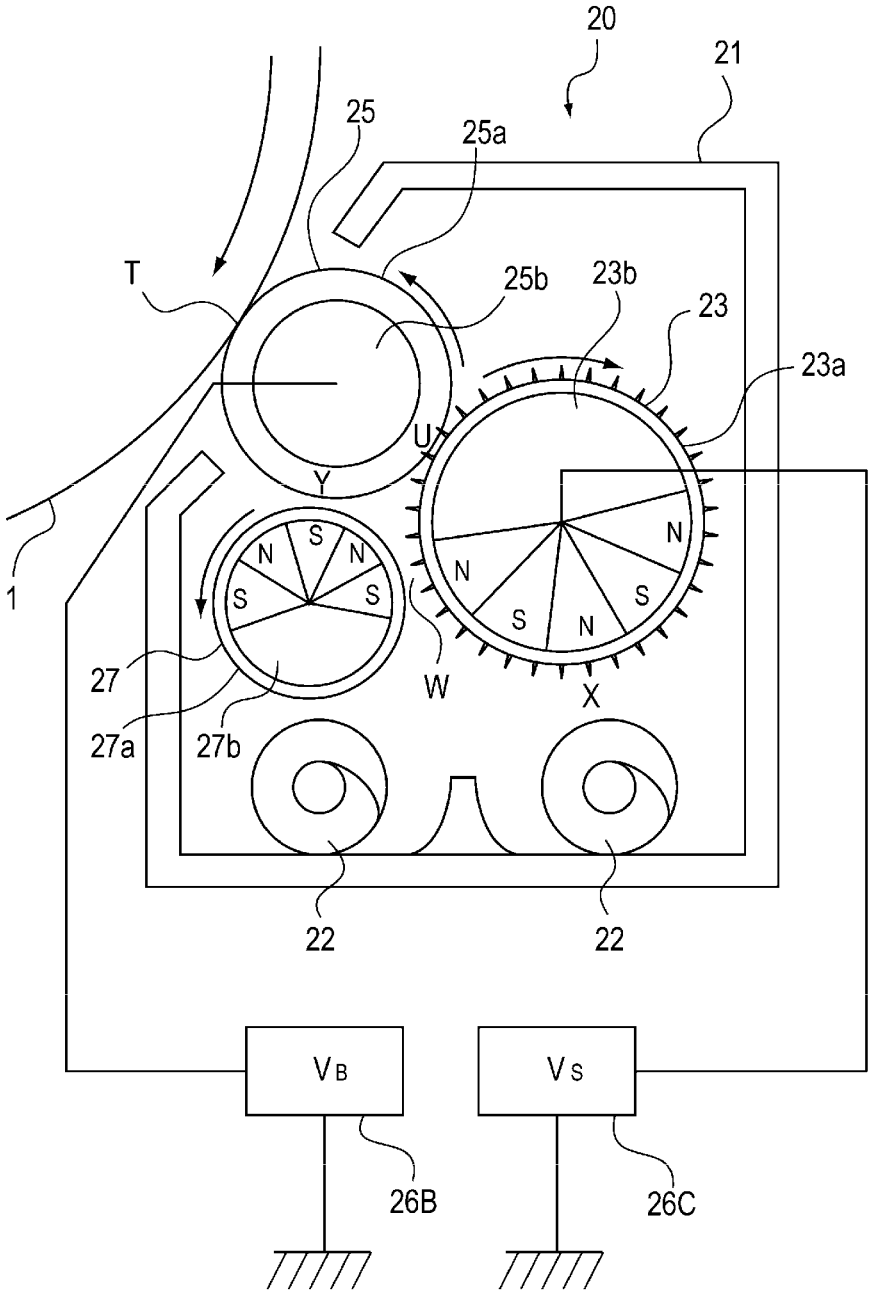
FIG. 2 is a schematic diagram illustrating an embodiment of the developing device according to the present invention.

FIG. 2 is a schematic diagram illustrating an embodiment of a developing device according to the present invention.

(Configuration of Developing Roll)

The developing device 20 according to the embodiment is arranged to face a photosensitive member 1. In an aperture of a developer container 21 of the developing device 20, a developing roll (toner carrying member) 25 is arranged to face the photosensitive member 1. The developing roll 25 is configured with a member having a structure where a cylindrical member having a metal material as a base layer 25*b* is coated with an elastic layer 25*a*.

Any material having conductivity and rigidity may be used for the base layer 25*b*, and for example, SUS, iron, aluminum, or the like may be used to form the conductive rigid member.

In the elastic layer 25*a*, a rubber material having an appropriate elasticity such as a silicone rubber, an acrylic rubber, a nitrile rubber, a urethane rubber, an ethylene propylene rubber, an iso-propylene rubber, or a styrene-butadiene rubber is used as the base material. The elastic layer is allowed to have conductivity by adding conductive fine particles such as carbon, titan oxide, or metal fine particles to the base material. In addition, besides the conductive fine particles, spherical resins may be dispersed in order to adjust surface roughness.

In the embodiment, the elastic layer 25*a* of the developing roll 25 is made of a silicone rubber or a urethane rubber, in which carbon is dispersed, and is formed on the base layer 25*b* made of stainless steel.

The developing roll 25 is arranged to be in contact with the photosensitive member 1. In addition, the developing roll is rotatably installed so as to rotate in the same direction as the rotational direction of the photosensitive member 1 in the developing portion T, and the circumferential velocities of the two rotations are set so as to be substantially equal to each other. In addition, in the embodiment, since so-called contact developing where the developing roll 25 and the photosensitive member 1 are allowed to be in contact with each other is performed, the developing roll 25 is configured with a member having elasticity or flexibility. However, in the case of non-contact developing, the developing roll is configured with a member having conductivity and rigidity, for example, SUS (stainless steel), iron, aluminum, or the like.

(Configuration of Toner Supplying Member)

Inside the developer container 21, the toner supplying member 23 is arranged to face and be in contact with the developing roll 25. Therefore, at least one of the developing roll 25 and the toner supplying member 23 needs to be configured with a member having elasticity or flexibility. The toner supplying member 23 is configured to include a toner supplying member 23*a* which transports the toner to a toner supplying portion U facing the developing roll 25 and a plurality of permanent magnets 23*b* which are arranged to be inside. In addition, in the toner supplying member 23*a*, a plurality of protrusion portions are regularly aligned in the moving direction of the toner supplying member 23*a*.

The developing roll 25 and the toner supplying member 23 are in contact with each other in the toner supplying portion U where the developing roll and the toner supplying member face each other, and the developing roll and the toner supplying member are applied with voltages $V_B$ and $V_S$ by voltage applying units 26B and 26S.

(Carrier Recovering Member)

In addition, a carrier recovering member 27 is arranged at a position which is upstream from the toner supplying portion U and downstream from a developer supplying portion X where a stirring/supplying member 22 which is a developer supplying portion and the toner supplying member 23 face each other in the moving direction of the toner supplying member 23*a*.

The carrier recovering member 27 faces the toner supplying member 23 and the developing roll 25 to recover the carrier by a magnetic force in a recovering portion W where the carrier recovering member faces the toner supplying member 23. The carrier recovering member 27 is configured to include a developer transporting portion 27*a* which transports the recovered developer to the stirring/supplying member 22 and a plurality of permanent magnets 27*b* which are arranged to be fixed inside thereof. The recovered developer is in contact with the developing roll 25 in the facing portion Y between the carrier recovering member 27 and the developing roll 25.

(Configuration of Protrusion Structure of Toner Supplying Member)

Figure 3A:
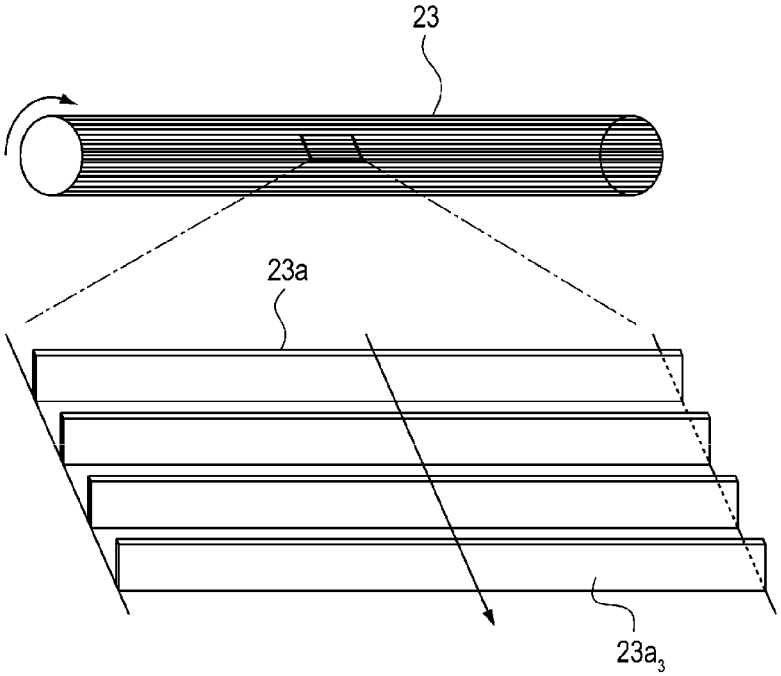
FIGS. 3A and 3B are schematic diagrams illustrating a protrusion structure of a toner supplying member.
Figure 3B:
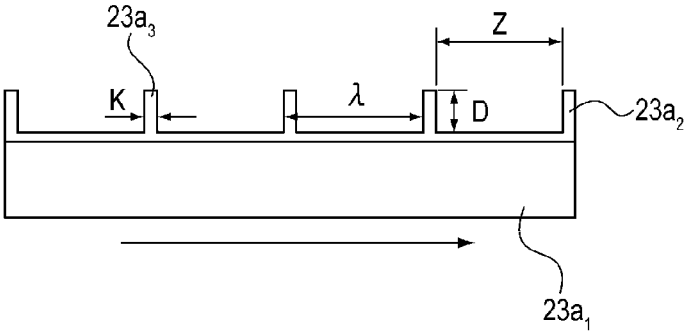

FIG. 3A is a schematic diagram illustrating a structure of protrusion portions of the toner supplying member 23*a*. FIG. 3B illustrates a cross-sectional diagram thereof.

The toner supplying member 23*a* is moved in the arrow directions of FIGS. 3A and 3B according to the rotation of the toner supplying member 23*a*. The toner supplying member 23*a* is configured to include a rotatable aluminum roll $\mathbf{23}a_1$ and a resin layer $\mathbf{23}a_2$ where protrusion structures where a plurality of protrusion portions $\mathbf{23}a_3$ are arranged on an outer layer surface thereof are regularly aligned in the moving direction of the toner supplying member 23*a*. Herein, the moving direction of the toner supplying member 23*a* is the toner transporting direction where the toner is to be transported, and the protrusion portions are installed to extend in the direction intersecting the toner transporting direction.

Herein, the protrusion structure is a structure including the protrusion portions $\mathbf{23}a_3$ which are installed to protrude on the surface of the toner supplying member 23*a* and to extend in the direction intersecting the direction where the toner is to be transported and the surface of the toner supplying member 23*a* between the protrusion portions $\mathbf{23}a_3$.

In this case, in order to increase the adhesion between the aluminum roll $\mathbf{23}a_1$ and the resin layer $\mathbf{23}a_2$, a primary layer may be installed therebetween.

In the embodiment, the protrusion structure is substantially parallel to the rotation axis of the aluminum roll $\mathbf{23}a_1$, and the protrusion structures where the protrusion portions $\mathbf{23}a_3$ having a width K of 1 μm and a height D of 3.5 μm are arranged are regularly aligned with a period λ which is 9 μm as an interval of the protrusion portions. In addition, in the embodiment, although the protrusion structures are installed to protrude substantially parallel to the rotation axis of the aluminum roll $\mathbf{23}a_1$, and the protrusion structures may be installed to be inclined with respect to the rotation axis. In addition, within the scope where the functions and effects of the present invention can be obtained, the present invention is not limited to the above-described protrusion structures, and any structures which are regularly aligned in the moving direction of the toner supplying member 23*a* may be employed.

In the embodiment, although the protrusion structure is formed by a light nanoimprinting method using a photocurable resin as the resin layer $\mathbf{23}a_2$, the protrusion structure may be formed by a thermal nanoimprinting method using a thermoplastic resin. In addition, instead of installing the resin layer $\mathbf{23}a_2$ in order to form the protrusion structure, the protrusion structure may also be directly formed on the aluminum roll $\mathbf{23}a_1$ by a laser edging method. In addition, in the case where the toner supplying member 23 is configured with a member having elasticity or flexibility, the protrusion structure may be directly formed on the elastic layer 25*a* by the thermal nanoimprinting method or the laser edging method. In addition, detailed methods of forming the protrusion structure will be described later.

The toner supplying member 23*a* is rotatably installed so as to be moved in the same direction as that of the developing roll in the toner supplying portion U which is the facing portion with respect to the developing roll 25, and the toner supplying member and the developing roll are set so as to be moved with a relative velocity difference in the toner supplying portion U. Details of the velocity will be described later. In addition, in the embodiment, the toner supplying member 23*a* and the developing roll 25 are rotated so as to be moved in the same direction, the toner supplying member and the developing roll may be rotated so as to be moved in the opposite direction.

(Brief Description of Toner Coat)

Figure 4:
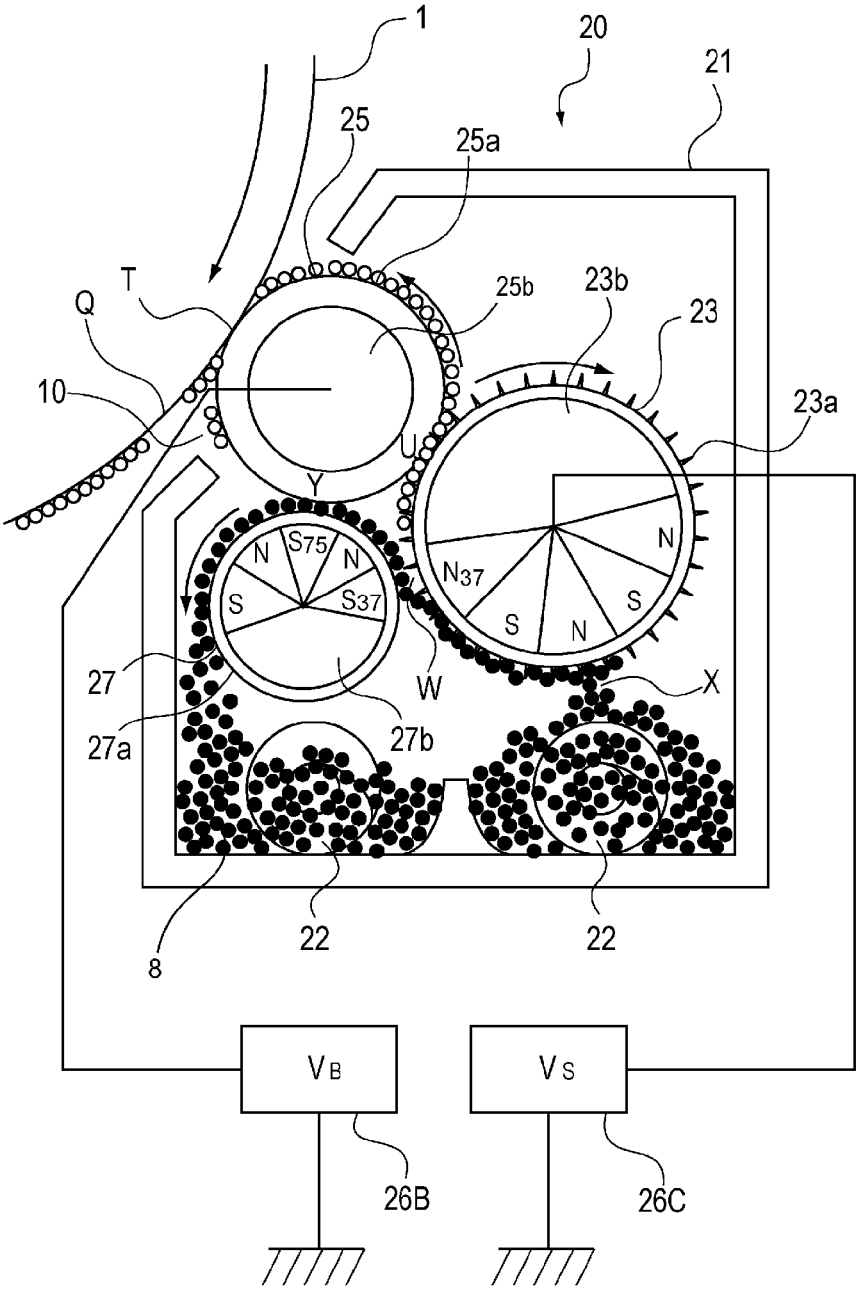
FIG. 4 is a schematic diagram illustrating a state where a developing roll is coated with a toner.

Next, the toner coat on the developing roll 25 is described in brief with reference to FIG. 4. In addition, in the present invention, coat denotes, for example, a form where toners (particles) are in contact with a surface of a developing roll, and the present invention is not necessarily limited to the form where the entire surface of the developing roll is covered with a large number of toners. Others will be described later in detail.

A two-component developer 8 (see FIG. 5A) is supplied by the stirring/supplying member 22 to the toner supplying member 23 having the protrusion structures which are regularly aligned on the surface. In the process where the developer 8 is supplied to the toner supplying member 23*a* and is transported until the developer is recovered by the carrier recovering member 27, the toner in the developer 8 which is in contact with the toner supplying member 23*a* is in contact with the side surface of the protrusion portion $\mathbf{23}a_3$, so that a stabilized, uniform, thin coating layer is formed on the surface layer of the toner supplying member 23*a*. The two-component developer 8 other than the toner involved with forming the coating layer is recovered onto the carrier recovering member 27 by a magnetic force in the recovering portion W.

On the other hand, the toner which is not recovered and coats the toner supplying member 23*a* is in contact with the developing roll 25 in the toner supplying portion U and coats the developing roll 25 by a potential difference. At this time, the coating of the toner supplying member 23*a* is allowed to be regularly uniform, and a moving velocity ratio $v_{23}/v_{25}$ is set appropriately, so that it is possible to coat the developing roll 25 with the toner particles stably at a high density. Herein, $v_{25}$ is the moving velocity of the developing roll, and $v_{23}$ is the moving velocity of the toner supplying member 23*a*.

Stability of the coat amount is advantageously obtained in addition to the above-described high-density coat. As expressed in the above-described Equation (1), in the case of the hybrid developing, if the potential difference ΔV is determined, the coat amount depends on Q/M. In other words, if the Q/M of the developer varies with a change in environment and durability, the coat amount is greatly changed. Therefore, in the hybrid developing, complicated voltage controlling needs to be performed by sensing the coat amount or the Q/M.

However, in the configuration according to the embodiment, since the toner is in contact with the protrusion structure on the toner supplying member 23 at multiple points, it is possible to coat the spaces between the protrusion portions $\mathbf{23}a_3$ included in the protrusion structure even with a small electrostatic adhesion force in comparison with the case where the toner is in contact with the outer circumferential surface of the roller at one point. In other words, although the charge amount of the toner varies and the electrostatic adhesion force varies, the toner amount of coating the protrusion structure is not easily varied, and it is possible to achieve a stable coat with the toner without depending on the complicated potential controlling.

(Detailed Description of Toner Coating)

Hereinafter, the coating with the toner will be described in detail with reference to FIG. 4.

The two-component developer 8 in the developer container 21 is stirred by the stirring/supplying member 22 and is transported to the developer supplying portion X. In the embodiment, a positively chargeable toner having a number-average particle diameter $r_t$ of 7.7 μm manufactured by polymerization method is used. As the magnetic carrier, a standard carrier P-01 (The Imaging Society of Japan) having a number-average particle diameter $r_c$ of 90 μm is used. In addition, the measurement method of the number-average particle diameters of the toner and the magnetic carrier will be described later. In addition, the toner and the magnetic carrier are not particularly limited to the above-described ones, but well-known toners and magnetic carriers which are generally used may be used.

First, the two-component developer 8 is formed by mixing the toner and the magnetic carrier with a toner mass ratio (TD ratio) 7% to the total mass. The two-component developer 8 transported to the developer supplying portion X is supplied to the toner supplying member 23*a* by the magnetic field generated by the permanent magnets 23*b* which are arranged to be fixed inside the toner supplying member 23. The supplied two-component developer 8 constitutes a magnetic brush due to the movement of the toner supplying member 23*a* and the influence of the magnetic field generated by the permanent magnets 23*b* and is transported in the same direction (arrow direction in the figure) as the moving direction of the toner supplying member 23*a*.

Figure 5A:
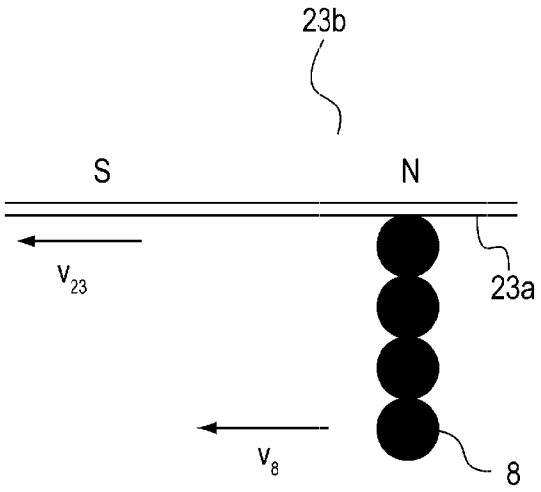
FIGS. 5A to 5C are schematic diagrams illustrating a state of transporting of a two-component developer.
Figure 5B:
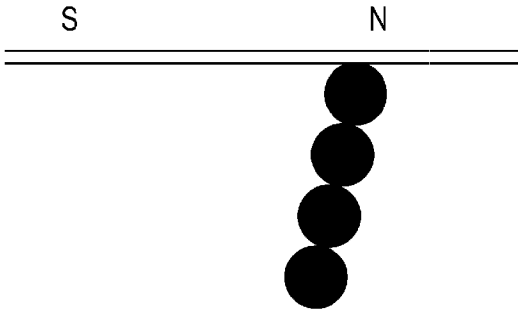
Figure 5C:
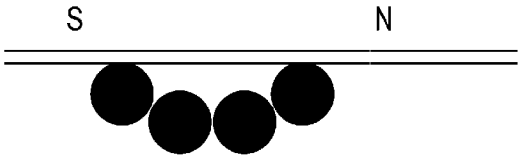

FIGS. 5A to 5C are schematic diagrams illustrating a state of transporting of the two-component developer 8. The two-component developer 8 constitutes the magnetic brush by the magnetic field generated by the permanent magnets 23*b* (FIG. 5A), and the magnetic brush starts to be influenced by adjacent poles according to the movement of the toner supplying member 23*a* (FIG. 5B). If the toner supplying member is further moved, the two-component developer is restrained by the adjacent poles (FIG. 5C). After that, these processes are repeated. Therefore, an average moving velocity $v_8$ of the two-component developer 8 has a relative velocity difference ($v_8 > v_{23}$) with respect to the moving velocity $v_{23}$ of the toner supplying member 23*a*.

Figure 6:
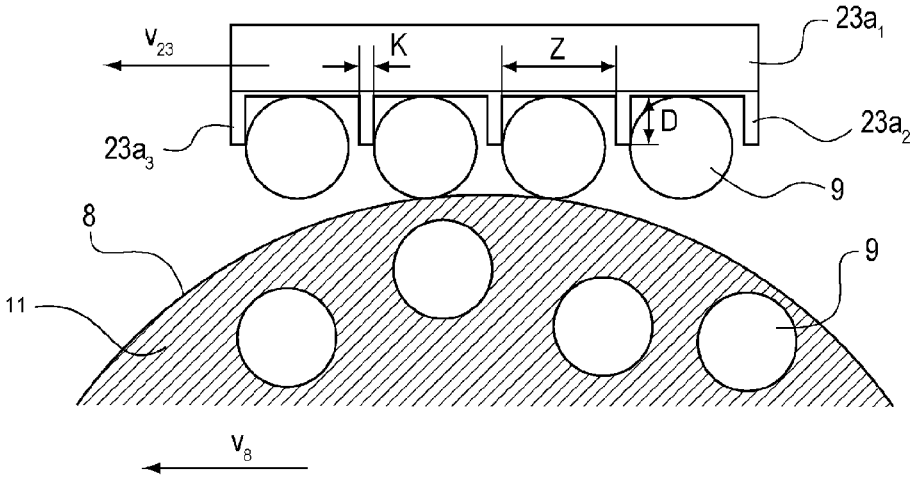
FIG. 6 is a schematic diagram illustrating a toner behavior during the transporting of the two-component developer in the toner supplying member.

FIG. 6 is a schematic diagram illustrating toner behavior during the transporting of the two-component developer 8 in the toner supplying member 23*a*. In addition, although only one magnetic carrier 11 is illustrated in the figure, in the actual case, a plurality of the magnetic carriers constituting the magnetic brush exist.

As illustrated in FIG. 6, the protrusion structures where the protrusion portions $\mathbf{23}a_3$ are arranged in the direction substantially perpendicular to the moving direction are formed to be regularly aligned on the toner supplying member 23*a*. In addition, the aperture width Z (=λ−K) formed by the adjacent protrusion portions $\mathbf{23}a_3$ is formed to be equal to or larger than the toner particle diameter $r_t$ and smaller than the carrier particle diameter $r_c$, and the height D of the protrusion portion $\mathbf{23}a_3$ is formed to be equal to or smaller than the toner particle diameter $r_t$.

The aperture width Z is formed to be equal to or larger than the toner particle diameter $r_t$ and smaller than the carrier particle diameter $r_c$, so that the magnetic carrier is not allowed to enter the aperture formed by the adjacent protrusion portions $\mathbf{23}a_3$. Therefore, the toner which is in contact with the side surfaces of the protrusion portions $\mathbf{23}a_3$ and the surface (bottom surface of the protrusion structure) between the protrusion portions $\mathbf{23}a_3$ at the multiple points is hardly scraped off by the magnetic brush which is transported later. In addition, the height D of the protrusion structure is formed to be equal to or smaller than the toner particle diameter $r_t$, so that there is no side surface of the protrusion portion $\mathbf{23}a_3$ where the toner of the second layer is adhered. Therefore, it is possible to coat the protrusion structure with a single layer of the toner.

As described above, according to the protrusion structure of the embodiment, it is possible to coat the toner supplying member 23*a* with a substantially single layer of the toner particles which is stable and uniform.

Figure 7A:
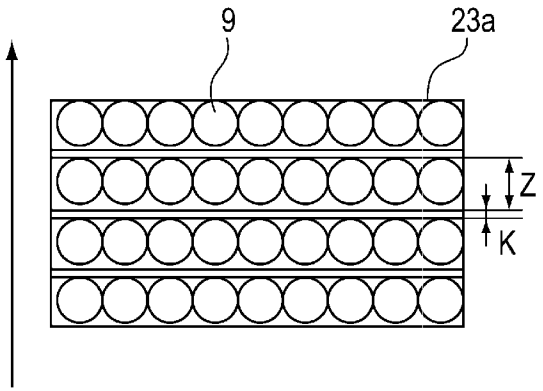
FIGS. 7A to 7C are schematic diagrams illustrating a toner image on the toner supplying member.
Figure 7B:
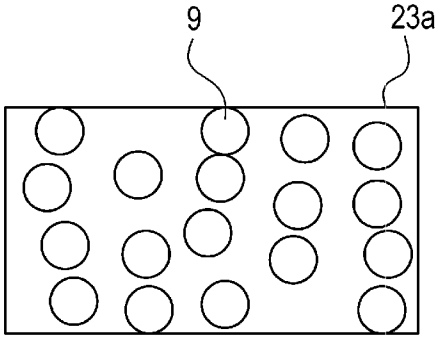
Figure 7C:
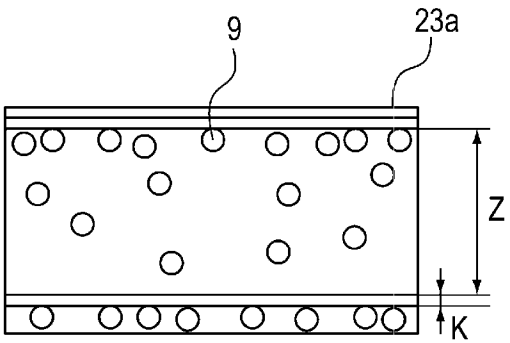

FIGS. 7A to 7C are schematic diagrams illustrating a toner image on the toner supplying member 23*a*. Herein, FIG. 7A illustrates a toner image formed by the toner which coats the toner supplying member 23*a* having the protrusion structure according to the embodiment. In addition, as comparative examples, FIG. 7B is a schematic diagram illustrating a toner image on the toner supplying member 23*a* having no protrusion structure, and FIG. 7C is a schematic diagram illustrating a toner image on the toner supplying member 23*a* where the aperture width Z is larger than the carrier particle diameter $r_c$. The arrow in the FIGS. 7A to 7C denotes the moving direction of the toner supplying member 23*a*.

As illustrated in FIG. 7B, in the case where the toner supplying member has no protrusion structure, a trace of scraping by the magnetic brush in the transporting direction of the magnetic brush, that is, in the direction parallel to the moving direction of the toner supplying member 23*a* is remarkable, and thus, it is not possible to form a uniform coat with the toner. In addition, as illustrated in FIG. 7C, in the case where the aperture width Z is equal to or larger than the carrier particle diameter $r_c$, it is not possible to form a uniform coat with the toner because of the entering of the magnetic carrier.

More preferably, the aperture width Z is formed to be smaller than three times the toner particle diameter ($Z<3r_t$). Therefore, since the space which the toner enters is limited excluding the space where the toner can be in contact with the side surfaces of the protrusion portions $\mathbf{23}a_3$ and the bottom surfaces between the protrusion portions $\mathbf{23}a_3$ at the multiple points, it is possible to perform coating with a single layer of the toner which is further stable and uniform. It is preferable to set the aperture width Z to 1 μm or more and 100 μm or less.

Figure 28:
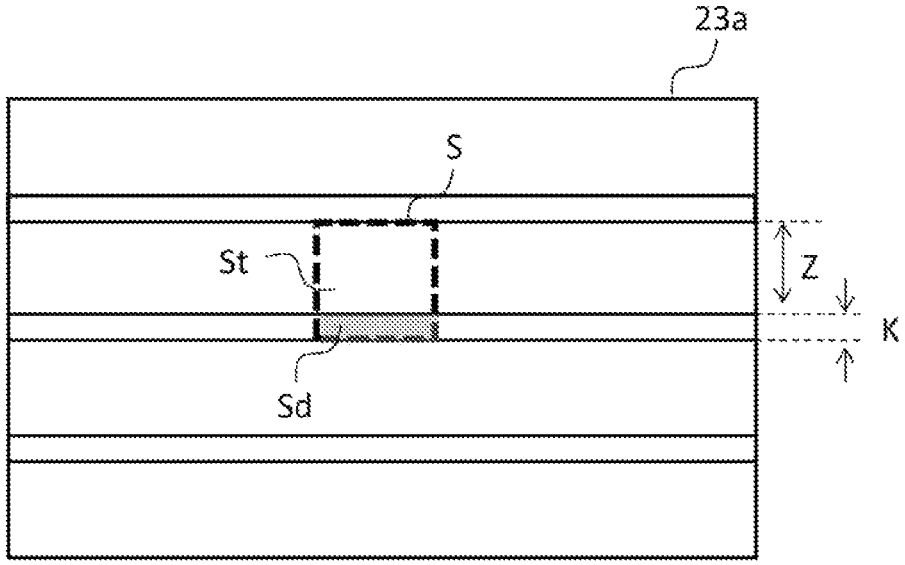
FIG. 28 is a schematic diagram illustrating a aperture formed by the adjacent protrusion portions on the toner supplying member.

The proportion of the protrusion portion on the toner supply member 23 is preferably set to 45% or less. FIG. 28 shows the region S (dashed line) on the toner supply member 23, the aperture portion St with the aperture width L on the region S and the protrusion portion Sd with the width K on the region S. The toner is coated on the aperture portion St. As described above, the toner of which amount is equal to or larger than that of the toner on the toner supplying member 23 is used for development on the photosensitive member 1. On the other hand, the toner amount required on the photosensitive member 1 is about the amount of toner with which toner particles are adhered to each other without any gap after fixing and a sheet can be covered with a toner image. Specifically, the total volume of the toner coated in the aperture portion St is not less than the volume of the cube determined by the product of the toner layer thickness dt after fixing and the area Sa of the region S.

$$\frac{Sta \cdot \kappa}{\rho} \geq Sa \cdot dt$$

(Sta: the area ($cm^2$) of the aperture portion St, Sa: the area ($cm^2$) of the region S, ρ: toner true specific gravity ($g/cm^3$), dt: toner layer thickness (cm) after fixing, κ: toner amount ($g/cm^2$) at the aperture portion St) The toner amount κ in the aperture portion St can be approximated by the following expression since the toner particles are substantially filled in the close-packed.

$$\kappa = \frac{\pi \cdot \rho \cdot rt}{3\sqrt{3}} \times 10^{-6}$$

The toner layer thickness dt after fixing can be approximated by the following expression from the above two expressions since it is possible to crush the toner particles to about ⅓ of the toner particle diameter rt.

$$\frac{Sta}{Sa} \geq 0.55$$

In other words, when the proportion of the protrusion portion on the toner supplying member 23 is 45% or less, it is possible to fix toner without any gap.

In addition, in order to secure adhesiveness between the side surface of the protrusion portions 23$a_3$ and the toner and adhesiveness between the toner involved with the coating and the developing roll 25 on the side surface of the protrusion portions 23$a_3$, the height D of the protrusion portion 23$a_3$ is preferably about 50% of the toner particle diameter $r_t$. At this time, if the particle size distribution of the toner is considered, the height D of the protrusion portion 23$a_3$ is preferably equal to or larger than $r_{t10}/2$ and equal to or smaller than $r_{t90}/2$. Herein, $r_{t10}$ is the particle diameter of the toner of which cumulative number distribution is 10% in the particle size distribution, and $r_{t90}$ is the particle diameter wherein the cumulative number distribution is 90%. If the height D of the protrusion portion 23$a_3$ is smaller than $r_{t10}/2$, the adhesiveness between the side surface of the protrusion portion 23$a_3$ and the toner is decreased, so that the particle diameter of the toner which coats the toner supplying member 23*a* is limited. Therefore, it is not possible to form a uniform coat.

On the other hand, if the height D of the protrusion portion 23$a_3$ is larger than $r_{t90}/2$, the adhesiveness between the toner which is in contact with the side surface of the protrusion portion 23$a_3$ and the developing roll 25 is decreased, so that the particle diameter of the toner which coats the developing roll 25 is limited. Therefore, it is not possible to form a high-density coat.

In the embodiment, in the case where the toner particle diameter $r_t$ is 7.7 μm, a structure where the height D is 3.5 μm and the aperture width Z is 8 μm is used. The two-component developer 8 is transported on the toner supplying member 23*a* with a relative velocity difference ($v_8 > v_{23}$). At this time, the toner in the transported two-component developer 8 is charged by being in contact with and rubbing against the protrusion structure on the toner supplying member 23*a*, and the toner is in contact with the protrusion portion at the multiple points mainly by the electrostatic adhesion force, so that a single coat layer of the toner is formed. Therefore, in comparison with the case where the toner is in contact with only the outer circumferential surface of the roller at one point, it is possible to form the coat with the toner even by a small electrostatic adhesion force.

On the other hand, if the electrostatic adhesion force at the contact point is large, there is no need to excessively increase the frequency of contacting and the friction between the developer and the toner supplying member 23*a*, so that it is possible to suppress deterioration of the developer. For this reason, it is preferable that a triboelectric series of the toner, the magnetic carrier, and the toner supplying member (protrusion structure) are aligned so that the magnetic carrier is disposed between the toner and the toner supplying member. In this condition, a difference of the triboelectric series between the toner and the toner supplying member becomes larger than a difference of the triboelectric series between the toner and the magnetic carrier. Therefore, when the toner and the toner supplying member are in contact with each other to be charged due to friction, a stronger electrostatic adhesion force than the electrostatic adhesion force between the toner and the magnetic carrier is generated, so that the toner is separated from the magnetic carrier and is easily adhered to the toner supplying member (protrusion structure).

As described above, according to the developing device of the embodiment, it is possible to form a coat layer by the uniform toner without excessively increasing the frequency of contacting and the friction between the developer and the toner supplying member. In addition, the method of determining the triboelectric series will be described later.

(Configuration of Developer Recovering)

The two-component developer 8 on the toner supplying member 23*a* is transported to the recovering portion W where the toner supplying member 23 and the carrier recovering member 27 face each other. In the recovering portion W, a strong magnetic field is generated by the pole $N_{37}$ (see FIG. 8) of the permanent magnets 23*b* which is arranged to be fixed inside the toner supplying member and the pole $S_{37}$ (see FIG. 8) of the permanent magnets 27*b* which is arranged to be fixed inside the carrier recovering member. Therefore, excluding the toner which coats the toner supplying member 23*a*, the two-component developer 8 transported to the recovering portion W is recovered by the carrier recovering member 27.

The recovered two-component developer 8 is transported to the facing portion Y between the carrier recovering member 27 and the developing roll 25 by the developer transporting portion 27*a* to be in contact with the developing roll 25. With respect to the two-component developer 8 carried in the carrier recovering member 27, since the toner for the coating is already supplied to the toner supplying member 23*a*, the toner mass ratio (TD ratio) is decreased. Therefore, the developer has a capability of recovering the toner and is in contact with the residual toner 10 which is not developed in the non-image portion Q, so that it is possible to recover the residual toner 10.

In the embodiment, although the carrier recovering member 27 is not applied with a voltage and is in an electrically floated state, a voltage may be applied. In this case, in order to recover the residual toner 10 in the facing portion Y, it is preferable that the voltage applied to the carrier recovering member 27 is set to be smaller than a DC voltage $V_B$ applied to the developing roll 25 (is set to be larger than $V_B$ in the case of using a negative-polarity toner). On the other hand, if the voltage is applied to the carrier recovering member 27, an electric field is also exerted to the recovering portion W. Even under the condition, the influence of the electric field on the toner which coats the side surfaces of the protrusion portions 23$a_3$ of the protrusion structure of the toner supplying member 23*a* becomes small due to the adhesive force of the component in the direction substantially perpendicular to the direction of the electric field.

On the other hand, since the other toner is securely recovered to the carrier recovering member 27, it is possible to form a coat on the toner supplying member 23 with a single layer of the toner which is further stable and uniform. In this case, it is more preferable that the magnetic pole (pole $S_{75}$, see FIG. 8) of the permanent magnet 27*b* which is arranged in the facing portion Y and the magnetic pole (pole $S_{37}$, see FIG. 8) of the permanent magnet 27*b* which is arranged in the recovering portion W have the same polarity.

Figures 8A, 8B, 8C:
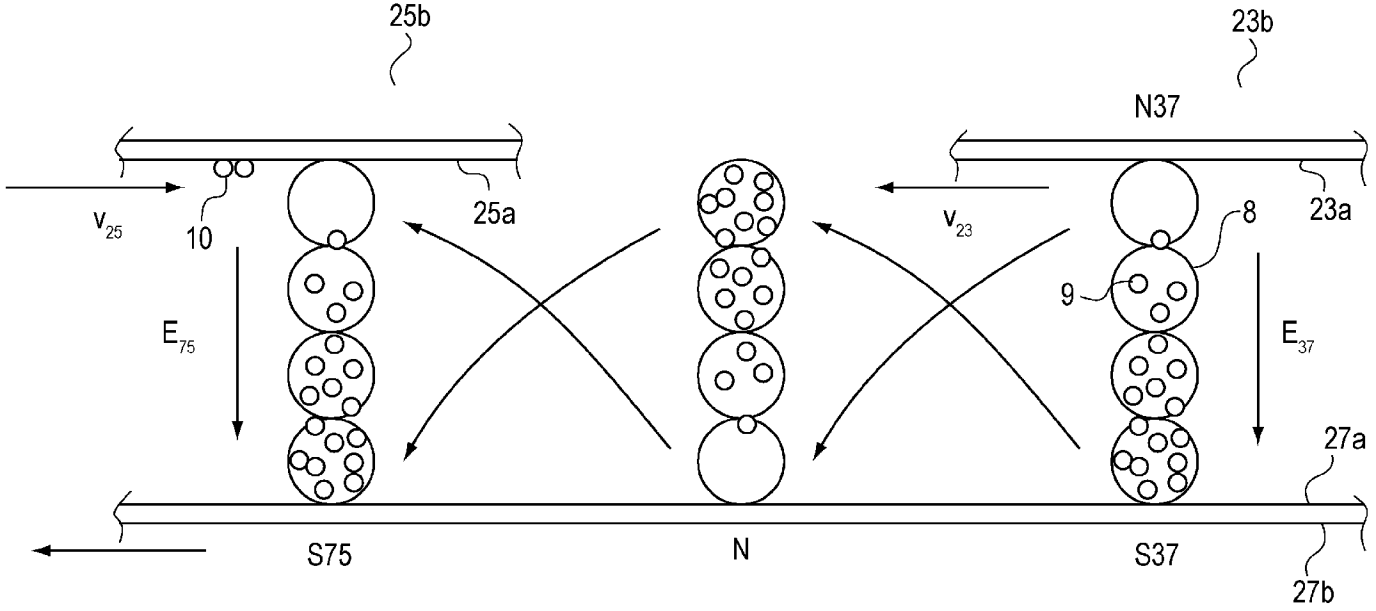
FIGS. 8A to 8C are schematic diagrams illustrating a behavior of a magnetic brush transported from a recovering portion W to a facing portion Y.

The reason is described with reference to FIGS. 8A to 8C. FIGS. 8A to 8C are schematic diagrams illustrating a behavior of the magnetic brush transported from the recovering portion W to the facing portion Y.

An electric field $E_{37}$ is exerted in the recovering portion W, the toner other than the toner which coats the side surfaces of the protrusion portions 23$a_3$ of the protrusion structure (not shown) of the toner supplying member 23*a* is scattered in the direction of the carrier recovering member 27, and the toner amount in the vicinity of the carrier recovering member 27 is increased (FIG. 8C). The magnetic brush is transported due to the movement of the developer transporting portion 27*a* and the magnetic field generated by the permanent magnet 27*b* (FIG. 8B), and the toner amount of the magnetic brush transported to the facing portion Y is decreased at the side in the vicinity of the developing roll 25 (FIG. 8A). Accordingly, since the magnetic carrier easily recovers the residual toner 10, it is possible to recover the toner even with a lower electric field $E_{75}$.

In addition, the present invention is not limited to the above-described magnetic pole configuration, and if any configuration where the magnetic pole of the permanent magnet 27*b* arranged in the facing portion Y and the magnetic pole of the permanent magnet 27*b* arranged in the recovering portion W have the same polarity may be employed.

In the recovering portion W and the facing portion Y, the recovered two-component developer and the residual toner 10 are returned to the stirring/supplying member 22 by a magnetic force and are stirred and transported again to be supplied to the developer supplying portion X.

The toner which is not recovered to the carrier recovering member 27 and coats the side surfaces of the protrusion portions 23$a_3$ of the protrusion structure of the toner supplying member 23*a* is transported to the toner supplying portion U. In the toner supplying portion U, the developing roll 25 and the toner supplying member 23 are in contact with each other, and the developing roll and the toner supplying member are applied with voltages $V_B$ and $V_S$ by the voltage applying units 26B and 26S, respectively. In the embodiment, the toner supplying member 23 is in contact with the developing roll 25 so that the entering amount becomes 50 μm. With respect to a latent potential ($V_L$=100 V) of the photosensitive member 1, DC 400 V is applied as the voltage $V_B$, and DC 800 V is applied as the voltage V.

(Moving Velocity Ratio of Developing Roll and Toner Supplying Member and Image Evaluation)

The developing roll 25 and the toner supplying member 23*a* are rotated in the same direction in the toner supplying portion U where the developing roll and the toner supplying member face each other, and the velocities thereof have a relative velocity difference. In the embodiment, the moving velocity $v_{25}$ of the developing roll 25 is set to be 200 mm/s, and the moving velocity $v_{23}$ of the toner supplying member 23 (toner supplying member 23*a*) is set to be 260 mm/s.

Figure 9:
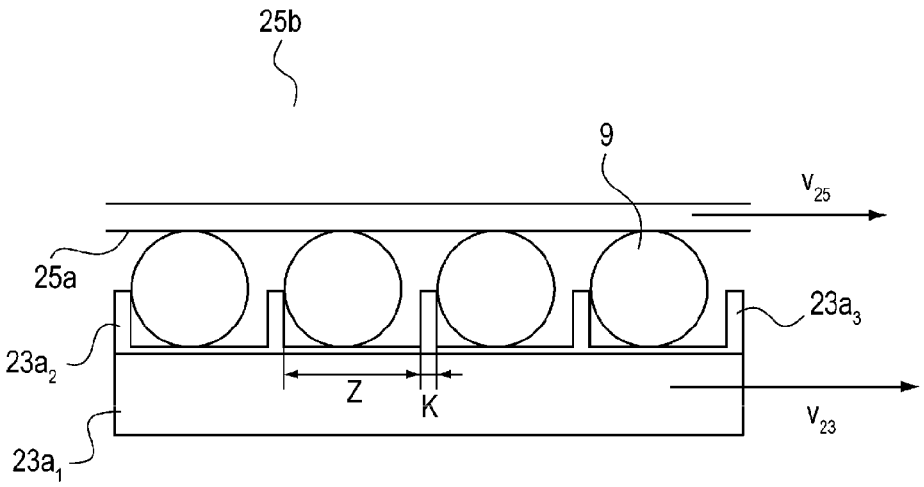
FIG. 9 is a schematic diagram illustrating a facing portion between the developing roll and the toner supplying member.

FIG. 9 is a schematic diagram illustrating the toner supplying portion U which is the facing portion between the developing roll 25 and the toner supplying member 23.

In the embodiment, since the aperture width Z (8 μm) is equal to or larger than the average toner particle diameter $r_t$ (7.7 μm) and is smaller than two times the toner particle diameter, only one toner having the average toner particle diameter can enter the space between the adjacent protrusion portions 23$a_3$.

Figure 10A:
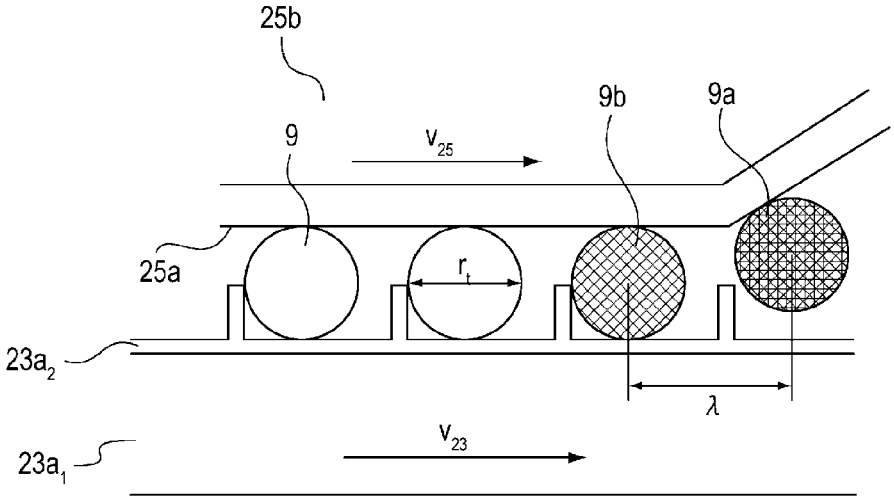
FIGS. 10A and 10B are schematic diagrams illustrating a rear end of the toner supplying portion in the case of satisfying $r_t \leq Z < 2r_t$.
Figure 10B:
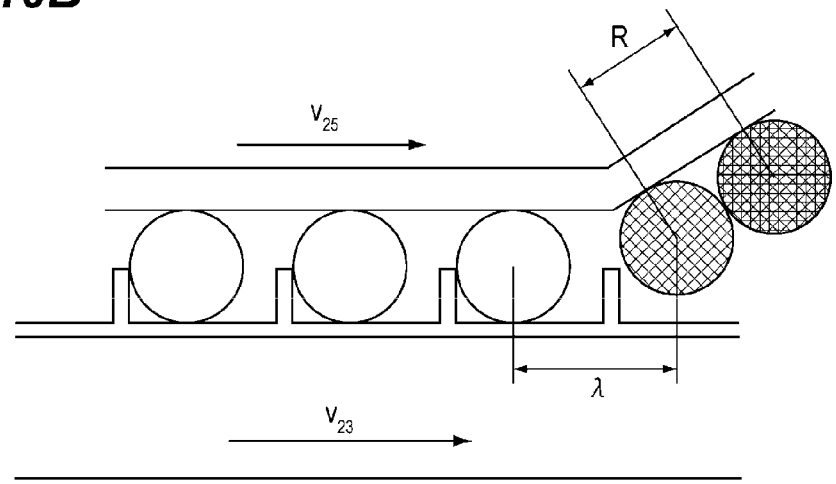

FIGS. 10A and 10B are schematic diagrams illustrating a rear end of the toner supplying portion U. FIG. 10A is a schematic diagram illustrating a state where a toner 9*a* at the front in the travelling direction passes through the rear end of exits from the toner supplying portion, and FIG. 10B is a schematic diagram illustrating a state where a toner 9*b* in the vicinity thereof passes though the rear end of the toner supplying portion after t seconds.

The toner is exerted with a force directing from the toner supplying member 23*a* to the developing roll 25 by the applied potential difference=$V_S$−$V_B$, and due to the relative velocity difference in the rotation velocity between the toner supplying member 23*a* and the developing roll 25 in the facing portion, a couple of forces is exerted to the toner. Therefore, the toner is easily rotated. Accordingly, the adhesive force between the toner and the toner supplying member 23*a* is decreased, so that the toner is moved to the developing roll 25 to coat the surface thereof.

In this case, the conditions of forming a coating on the developing roll 25 with the toners at a high density are classified according to the condition of the aperture width Z and the toner particle diameter $r_t$.

$$r_t \leq Z < 2r_t \quad \text{(A)}$$

In this case, a distance R between the centers of the two toners 9*a* and 9*b* in contact with each other which coat the developing roll 25 after t seconds described above becomes $r_t$ which is equal to the toner particle diameter (diameter of the toner).

The time taken for the toner 9*a* to travel the distance R is expressed by the following equation.

$$t = R/v_{25} = r_t/v_{25} \quad \text{Equation (2)}$$

In the interval of time t, since the toner 9*b* needs to move the distance λ, the following equation is obtained.

$$v_{23}t = \lambda \quad \text{Equation (3)}$$

A moving velocity ratio $v_{23}/v_{25}$ of the toner supplying member 23*a* to the moving velocity $v_{25}$ of the developing roll 25 is expressed by using Equations (2) and (3).

$$v_{23}/v_{25} = \lambda/R = \lambda/r_t \quad \text{Equation (4)}$$

In the actual case, since the toner 9*b* is pressed against the toner 9*a*, the distance R between the centers of the two toners may be equal to or smaller than the toner particle diameter $r_t$. The above-described Equation (4) can be expressed as follows.

$$v_{23}/v_{25} \geq \lambda/R = \lambda/r_t \quad \text{Equation (5)}$$

Table 1 lists results of toner amounts, coat ratios, and density evaluations after fixing involved with the coat when the moving velocity ratio $v_{23}/v_{25}$ is changed in the embodiment. In addition, the evaluation methods thereof will be described later.

TABLE 1

| $V_{23}/V_{25}$ | 1.1 | 1.2 | 1.3 | 1.4 | 1.5 | 1.6 |
|---|---|---|---|---|---|---|
| Toner Amount of Coat (mg/cm$^2$) | 0.35 | 0.38 | 0.41 | 0.44 | 0.47 | 0.50 |
| Coat Ratio (%) | 74 | 80 | 86 | 92 | 93 | 96 |
| Density Evaluation | X | ○ | ○ | ○ | ○ | ○ |

Z = 8.0 μm,
K = 1.0 μm,
λ = 9.0 μm,
$r_t$ = 7.7 μm

The condition of forming a high-density coat layer by allowing the toners to be in contact with each other on the developing roll is obtained from Equation (5).

$$v_{23}/v_{25} \geq 1.17$$

As clarified from Table 1, it is found out that, if the ratio is set to be the moving velocity ratio $v_{23}/v_{25}$ (1.2 or more)

satisfying the Equation (5), it is possible to form a high-density coat on the developing roll 25 with the toners, so that it is possible to achieve a desired density. In addition, in the case of forming a coat with multiple layers of the toner, the velocity ratio may be set to be equal to or larger than the velocity ratio obtained by multiplying the velocity ratio of Equation (5) with a desired number of toner layers.

Next, the evaluation in the condition where $v_{23}/v_{25}=1.4$ based on the embodiment and the evaluation by the hybrid system as a comparative example are compared. Table 2 lists results of toner amounts, coat ratios, and density evaluations after fixing when the developing roll 25 is coated with the toner.

TABLE 2

| | Toner Amount of Coat ($mg/cm^2$) | Coat Ratio (%) | Density Evaluation |
|---|---|---|---|
| System of Embodiment | 0.44 | 92 | ○ |
| Hybrid System | 0.44 | 76 | X |

It is found out that, in the system of the embodiment, a toner coat layer which is a substantially single layer and has a high density is achieved, and however, in the hybrid system, the coat ratio is low and a plurality of second layers of the toner exist even though the toner amount is adjusted so as to be the toner amount corresponding to the same coat as that of the system of the embodiment. In addition, it is found out that, in the hybrid system, because of bad influence of the low coat ratio on the developing roll 25, the image formed on the photosensitive member 1 and the sheet also has a low toner density, and because of influence of the white portion of the sheet where no toner exists, the image density is greatly decreased, so that a desired density is not achieved.

$$2r_t \leq Z < r_c \quad \text{(B)}$$

The derivation of the moving velocity ratio $v_{23}/v_{25}$ in the condition where the aperture width Z is $2r_t \leq Z < r_c$ will be described.

Figure 11:
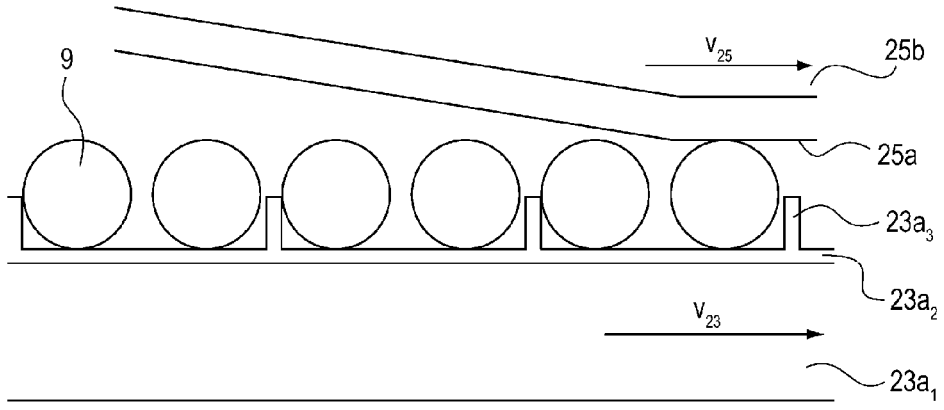
FIG. 11 is a schematic diagram illustrating a front end of the toner supplying portion in the case of satisfying $2r_t \leq Z < r_c$.

FIG. 11 is a schematic diagram before entering the toner supplying portion U. Before entering the toner supplying portion, two toner particles exist at the positions on the toner supplying member 23*a* so that the two toners are able to be in contact with both of the side surface of the protrusion portion 23$a_3$ of the protrusion structure and the surfaces of the toner supplying member 23*a* between the protrusion portions 23$a_3$ (bottom surfaces between the protrusion portions).

Figure 12A:
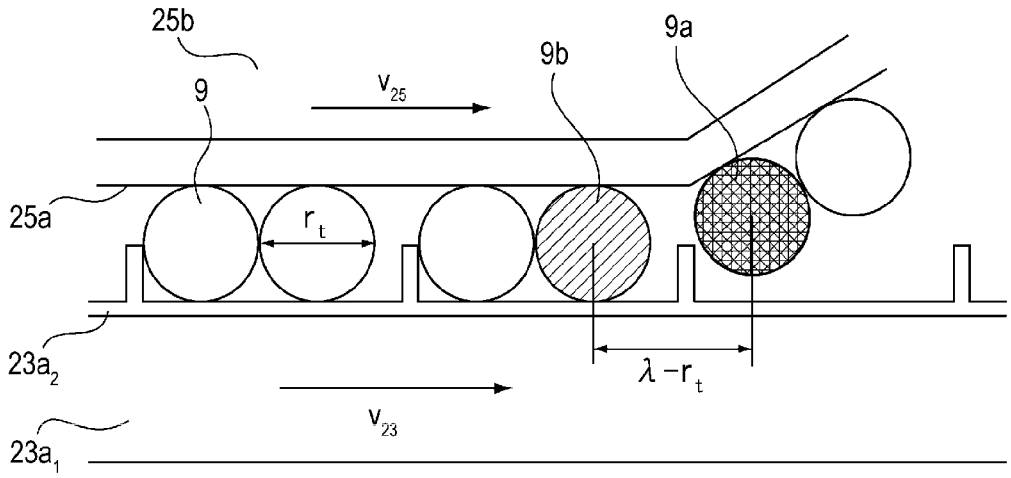
FIGS. 12A and 12B are schematic diagrams illustrating a rear end of the toner supplying portion in the case of satisfying $2r_t \leq Z < r_c$.
Figure 12B:
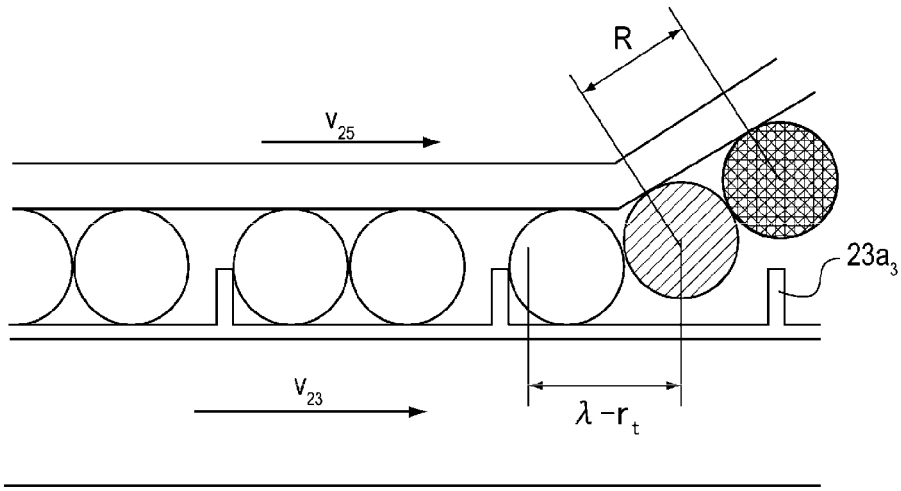

FIGS. 12A and 12B are schematic diagrams illustrating a rear end of the toner supplying portion. The toner is rotationally moved toward the downstream in the moving direction of the toner supplying member 23*a* by the moving velocity ratio $v_{23}/v_{25}$ during the contact.

FIG. 12A is a schematic diagram illustrating a state where the toner 9*a* passes through a rear end of a contact portion, and FIG. 12B is a schematic diagram illustrating a state where the toner 9*b* in the vicinity thereof passes through the rear end of the contact portion after t seconds. The condition of forming a high-density coat on the developing roll 25 with the toners is that, in an interval of t seconds, the toner 9*a* moves the distance R, and the toner 9*b* moves the distance $(\lambda - r_t)$. The following Equation (6) can be obtained from the above relationship.

$$v_{23}/v_{25} \geq (\lambda - r_t)/R = (\lambda - r_t)/r_t \quad \text{Equation (6)}$$

Tables 3 to 5 list results of similar examination performed by using the toner supplying members 23 having different structures on the toner supplying member 23*a*.

TABLE 3

| $V_{23}/V_{25}$ | 1.1 | 1.2 | 1.3 | 1.4 | 1.5 | 1.6 |
|---|---|---|---|---|---|---|
| Toner Amount of Coat ($mg/cm^2$) | 0.28 | 0.31 | 0.33 | 0.36 | 0.38 | 0.41 |
| Coat Ratio (%) | 59 | 65 | 69 | 76 | 80 | 85 |
| Density Evaluation | X | X | X | X | ○ | ○ |

Z = 9.0 μm,
K = 2.0 μm,
λ = 11 μm,
$r_t$ = 7.7 μm

Although $v_{23}/v_{25} \geq 1.43$ is obtained from Equation (5) based on the above-described condition (A), in the actual case, as clarified from Table 3, it is possible to obtain a desired density evaluation when the moving velocity ratio $v_{23}/v_{25}$ is equal to or larger than 1.5.

TABLE 4

| $V_{23}/V_{25}$ | 1.1 | 1.2 | 1.3 | 1.4 | 1.5 | 1.6 |
|---|---|---|---|---|---|---|
| Toner Amount of Coat ($mg/cm^2$) | 0.32 | 0.35 | 0.38 | 0.41 | 0.45 | 0.47 |
| Coat Ratio (%) | 67 | 74 | 80 | 86 | 92 | 94 |
| Density Evaluation | X | X | ○ | ○ | ○ | ○ |

Z = 15 μm,
K = 2.0 μm,
λ = 17 μm,
$r_t$ = 7.7 μm

Although $v_{23}/v_{25} \geq 1.21$ is obtained from Equation (6) based on the above-described condition (B), in the actual case, as clarified from Table 4, it is possible to obtain a desired density evaluation when the moving velocity ratio $v_{23}/v_{25}$ is equal to or larger than 1.3.

TABLE 5

| $V_{23}/V_{25}$ | 1.1 | 1.2 | 1.3 | 1.4 | 1.5 | 1.6 |
|---|---|---|---|---|---|---|
| Toner Amount of Coat ($mg/cm^2$) | 0.27 | 0.30 | 0.33 | 0.36 | 0.38 | 0.41 |
| Coat Ratio (%) | 57 | 63 | 69 | 76 | 80 | 86 |
| Density Evaluation | X | X | X | X | ○ | ○ |

Z = 18 μm,
K = 1.0 μm,
λ = 19 μm,
$r_t$ = 7.7 μm

Although $v_{23}/v_{25} \geq 1.47$ is obtained from Equation (6) based on the above-described condition (B), in the actual case, as clarified from Table 5, it is possible to obtain a desired density evaluation when the moving velocity ratio $v_{23}/v_{25}$ is equal to or larger than 1.5.

It has been found out that, even in the case where the structures are different, if the moving velocity ratio is set to the moving velocity ratio $v_{23}/v_{25}$ satisfying Equations (5) and (6), it is possible to form a high-density coat on the developing roll 25 with the toners, so that it is possible to achieve a desired density.

On the other hand, if the aperture width Z is equal to or larger than three times the toner particle diameter ($Z \geq 3r_t$), the stability of the coat amount by the toner is lowered.

Figure 13:
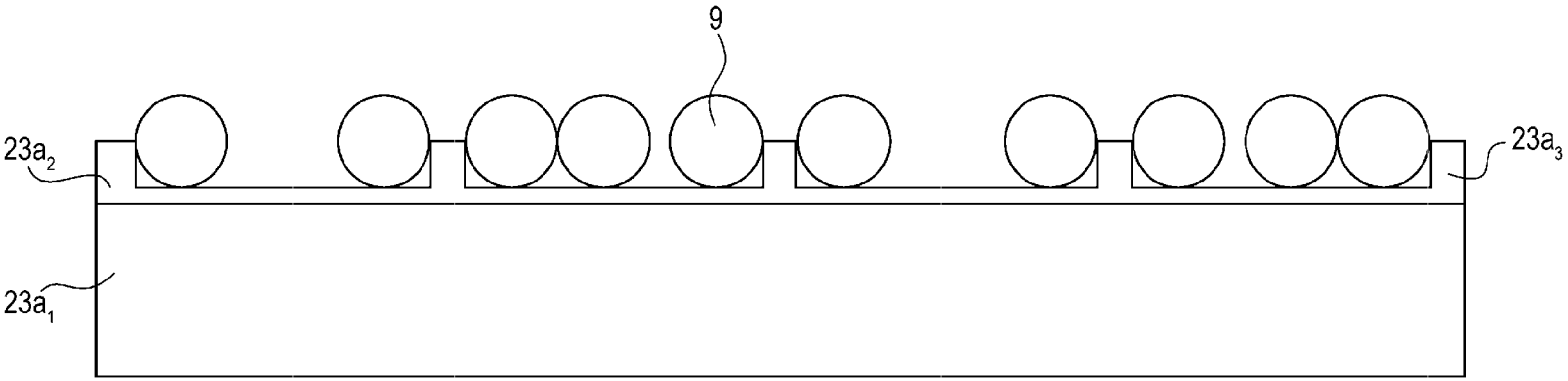
FIG. 13 is a schematic diagram illustrating a state of a coat in the case where an aperture width of the toner supplying member is equal to or larger than three times the particle diameter.

FIG. 13 is a schematic diagram illustrating the toner supplying member 23*a* in the case where the aperture width is equal to or larger than three times the toner particle diameter.

As illustrated in FIG. 13, if the aperture width Z is equal to or larger than three times the toner particle diameter ($Z \geq 3r_t$), in addition to the two toner particles which are in contact with the side surface of the protrusion portion 23$a_3$ and the bottom surface between the protrusion portions 23$a_3$ to be stable, the toner corresponding to the average particle diameter $r_t$ is likely to be in contact with only the bottom surface (so one of the three toner particles than can fit in the aperture width Z will only be in contact with the bottom surface). Therefore, it is considered that the stability is lowered.

In this manner, it is preferable that the aperture width Z is set to be smaller than three times the toner particle diameter ($Z < 3r_t$). Under the condition, the space which the unstable toner being in contact with only the bottom surface between the protrusion portions 23$a_3$ enters is limited, and the toner amount involved with the coat in terms of structure and space is regulated, so that it is possible to form a further stable, uniform single coat layer.

Tables 6 and 7 list results of similar examination performed by using toners having an average particle diameter $r_t$ of 5.0 μm (specific gravity: 1.1 g/cm$^3$).

TABLE 6

| $V_{23}/V_{25}$ | 1.1 | 1.2 | 1.3 | 1.4 | 1.5 | 1.6 |
|---|---|---|---|---|---|---|
| Toner Amount of Coat (mg/cm$^2$) | 0.19 | 0.21 | 0.23 | 0.25 | 0.27 | 0.29 |
| Coat Ratio (%) | 62 | 67 | 74 | 80 | 86 | 92 |
| Density Evaluation | X | X | X | ○ | ○ | ○ |

Z = 6.0 μm,
K = 1.0 μm,
λ = 7.0 μm,
$r_t$ = 5.0 μm

Although $v_{23}/v_{25} \geq 1.40$ is obtained from Equation (5) based on the above-described condition (A), in the actual case, as clarified from Table 6, it is possible to obtain a desired density evaluation when the moving velocity ratio $v_{23}/v_{25}$ is equal to or larger than 1.4.

TABLE 7

| $V_{23}/V_{25}$ | 1.1 | 1.2 | 1.3 | 1.4 | 1.5 | 1.6 |
|---|---|---|---|---|---|---|
| Toner Amount of Coat (mg/cm$^2$) | 0.19 | 0.21 | 0.23 | 0.25 | 0.27 | 0.29 |
| Coat Ratio (%) | 62 | 67 | 74 | 80 | 86 | 92 |
| Density Evaluation | X | X | X | ○ | ○ | ○ |

Z = 11 μm,
K = 1.0 μm,
λ = 12 μm,
$r_t$ = 5.0 μm

Although $v_{23}/v_{25} \geq 1.40$ is obtained from Equation (6) based on the above-described condition (B), in the actual case, as clarified from Table 7, it is possible to obtain a desired density evaluation when the moving velocity ratio $v_{23}/v_{25}$ is equal to or larger than 1.4.

Next, the evaluation in the condition where $v_{23}/v_{25}=1.6$ based on the embodiment and the evaluation by the hybrid system as a comparative example are compared. Table 8 lists results of toner amounts, coat ratios, and density evaluations after fixing when the developing roll 25 is coated with the toner.

TABLE 8

| | Toner Amount of Coat (mg/cm$^2$) | Coat Ratio (%) | Density Evaluation |
|---|---|---|---|
| System of Embodiment | 0.29 | 92 | ○ |
| Hybrid System | 0.29 | 77 | X |

It is found out that, in the system of the embodiment, a toner coat layer which is a substantially single layer and has a high density is achieved, and however, in the hybrid system, the coat ratio is low and the result of the density evolution is also bad even though the toner amount is adjusted so as to be the toner amount corresponding to the same coat as that of the system of the embodiment.

Tables 9 and 10 list results of similar examination performed by using toners having an average particle diameter $r_t$ of 10 μm (specific gravity: 1.1 g/cm$^3$).

TABLE 9

| $V_{23}/V_{25}$ | 1.1 | 1.2 | 1.3 | 1.4 | 1.5 | 1.6 |
|---|---|---|---|---|---|---|
| Toner Amount of Coat (mg/cm$^2$) | 0.46 | 0.49 | 0.53 | 0.57 | 0.60 | 0.62 |
| Coat Ratio (%) | 75 | 80 | 87 | 92 | 93 | 95 |
| Density Evaluation | X | ○ | ○ | ○ | ○ | ○ |

Z = 11 μm,
K = 1.0 μm,
λ = 12 μm,
$r_t$ = 10 μm

Although $v_{23}/v_{25} \geq 1.20$ is obtained from Equation (5) based on the above-described condition (A), in the actual case, as clarified from Table 9, it is possible to obtain a desired density evaluation when the moving velocity ratio $v_{23}/v_{25}$ is equal to or larger than 1.2.

TABLE 10

| $V_{23}/V_{25}$ | 1.1 | 1.2 | 1.3 | 1.4 | 1.5 | 1.6 |
|---|---|---|---|---|---|---|
| Toner Amount of Coat (mg/cm$^2$) | 0.46 | 0.49 | 0.53 | 0.57 | 0.60 | 0.62 |
| Coat Ratio (%) | 75 | 80 | 87 | 92 | 93 | 95 |
| Density Evaluation | X | ○ | ○ | ○ | ○ | ○ |

Z = 21 μm,
K = 1.0 μm,
λ = 22 μm,
$r_t$ = 10 μm

Although $v_{23}/v_{25} \geq 1.20$ is obtained from Equation (6) based on the above-described condition (B), in the actual case, as clarified from Table 10, it is possible to obtain a desired density evaluation when the moving velocity ratio $v_{23}/v_{25}$ is equal to or larger than 1.2.

Next, the evaluation in the condition where $v_{23}/v_{25}=1.4$ based on the embodiment and the evaluation by the hybrid system as a comparative example are compared. Table 11 lists results of toner amounts, coat ratios, and density evaluations after fixing when the developing roll 25 is coated with the toner.

TABLE 11

| | Toner Amount of Coat ($mg/cm^2$) | Coat Ratio (%) | Density Evaluation |
|---|---|---|---|
| System of Embodiment | 0.57 | 92 | ○ |
| Hybrid System | 0.57 | 75 | X |

It is found out that, in the case where the particle diameters of the toners are different, if the moving velocity ratio is set to the moving velocity ratio $v_{23}/v_{25}$ satisfying Equations (5) and (6), it is possible to form a coat on the developing roll 25 with the toners at a high density, so that it is possible to achieve a desired density.

As described above, a thin, uniform, stable toner coat is formed to be in contact with the side surface of the protrusion portions $\mathbf{23}a_3$ of the protrusion structure by allowing the two-component developer 8 to be in contact with the toner supplying member 23 where the protrusion structures are regularly aligned on the surface, and the residual two-component developer 8 is recovered by the carrier recovering member 27. After that, the toner supplying member 23 and the developing roll 25 are in contact with each other, and if the potential difference and the moving velocity ratio determined by Equation (5) or Equation (6) are set, it is possible to form a coat on the developing roll 25 with the toners stably at a high density even in the case of a small toner amount. In addition, it is possible to achieve a desired density and to improve density irregularity.

(Relationship Between Period of Protrusion Structures and Color Difference)

In the above-described examination, although the protrusion structure on the toner supplying member 23 is a periodic structure ($\lambda$ fixed), other periodic structures may be combined.

Figure 14:
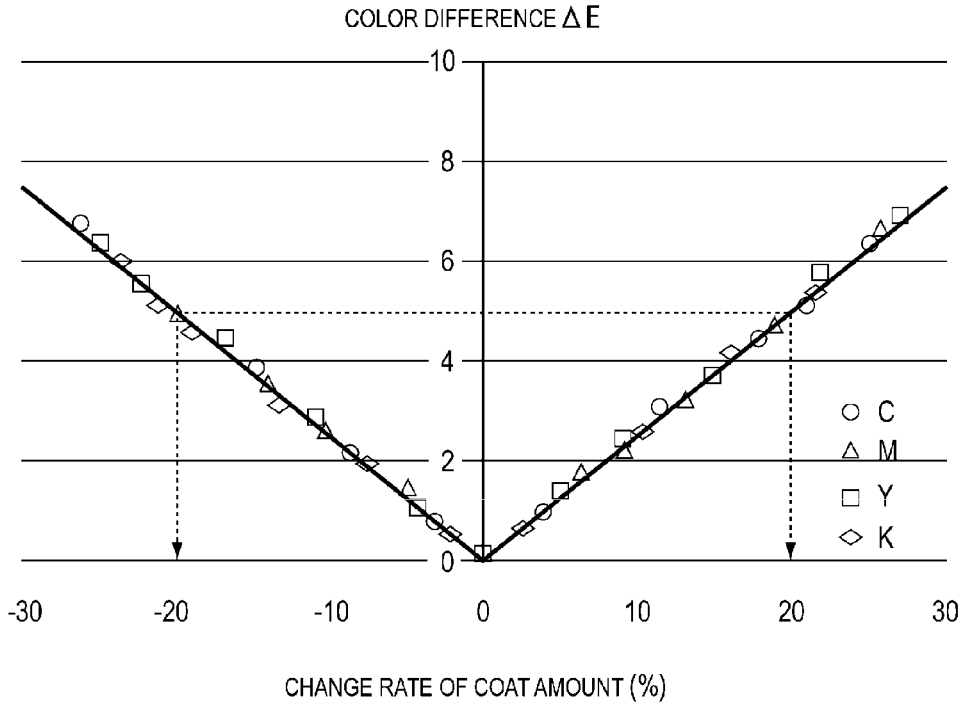
FIG. 14 is a diagram illustrating a relationship between a change rate of a coat amount and a color difference ΔE by using as a standard the case of coating the developing roll with each color toner having a constant amount.

FIG. 14 is a diagram illustrating a relationship between a change rate (horizontal axis) of a toner amount involved with a coat and a color difference $\Delta E$ (vertical axis) in the case where the developing roll 25 is coated with each toner of cyan (C), magenta (M), yellow (Y), and black (K) having a toner amount of 0.45 $mg/cm^2$.

Herein, in order to keep the in-plane color difference $\Delta E$ of each color at or below 5, the change rate of the toner amount involved with the coat needs to be maintained to be within ±20%. In the system of the embodiment, when the moving velocity ratio $v_{23}/v_{25}$ is determined, the toner amount involved with the coat on the developing roll 25 is proportional to $\lambda$ (Equation (5)) or $\lambda-r_t$ (Equation (6)) according to the condition (A) or (B) of the aperture width Z and the toner particle diameter $r_t$. Therefore, in order to suppress the in-plane color difference $\Delta E$ within 5, if the period when the change rate is 0% is denoted by $\lambda_0$, the period $\lambda$ may be a mixture in the following range.

(a) Equal to or larger than $0.8\lambda_0$ and equal to or smaller than $1.2\lambda_0$ in the case of the Condition (A)

(b) Equal to or larger than $(0.8\lambda_0+0.2r_t)$ and equal to or smaller than $(1.2\lambda_0-0.2r_t)$ in the case of the Condition (B)

In addition, if the period $\lambda$ is within the following ranges, (a) Equal to or larger than $0.9\lambda_0$ and equal to or smaller than $1.1\lambda_0$ in the case of the Condition (A)

(b) Equal to or larger than $(0.9\lambda_0+0.1r_t)$ and equal to or smaller than $(1.1\lambda_0-0.1r_t)$ in the case of the Condition (B)

More preferably, the in-plane color difference $\Delta E$ is suppressed within 3.

A mixture of the protrusion structures having different periods within the above-described allowable ranges is also included in the protrusion structure of the embodiment.

(Method of Forming Protrusion Structure)

The protrusion structure on the toner supplying member 23 may be formed by a light nanoimprinting method using a photo-curable resin, a thermal nanoimprinting method using a thermoplastic resin, a laser edging method of performing edging by scanning a laser, or the like.

Figure 15:
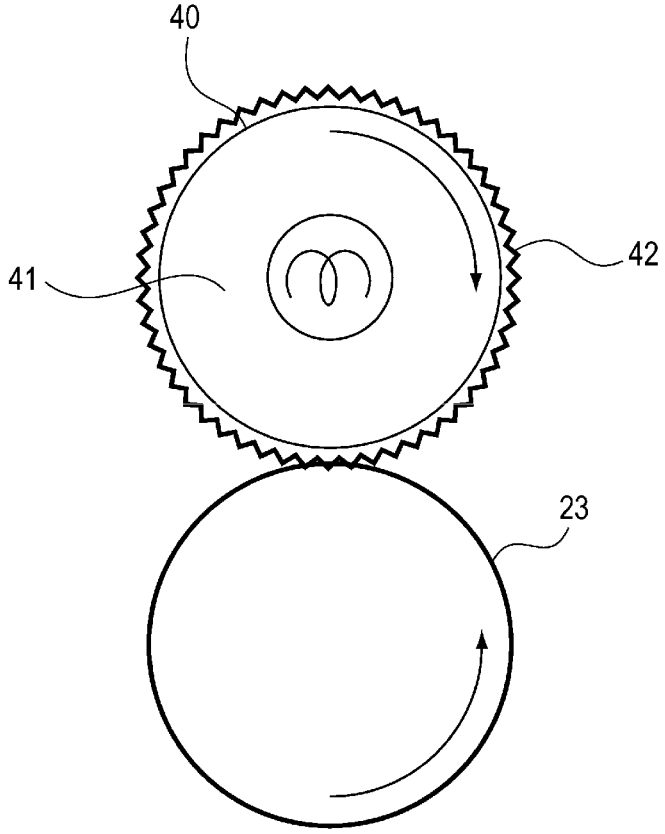
FIG. 15 is a schematic diagram illustrating an example of a method of forming the protrusion structure on the toner supplying member.

FIG. 15 is a schematic diagram illustrating an example of a method of forming the protrusion structure on the toner supplying member 23*a*.

Herein, the method of forming the protrusion structure on the toner supplying member 23*a* by the thermal nanoimprinting method will be described.

A film mold 42 having a recess structure which is a structure reverse to a desired protrusion structure is fixed on a transfer roll 40 having a built in halogen heater 41. Next, the film mold 42 is pressed while being in contact with the toner supplying member 23. While rotating the transfer roll 40 and the toner supplying member 23 at a constant velocity in this state, the protrusion structure is formed by performing heating by the halogen heater 41 at a temperature within a range of from a glass transition temperature to a melting point.

In this case, as illustrated in FIG. 15, the protrusion structure may be directly formed on the outer layer surface of the toner supplying member 23, or after the thermoplastic resin is applied in advance, the protrusion structure may be formed in the resin.

In the light nanoimprinting method, the photo-curable resin is applied on the outer layer surface of the toner supplying member 23, and the protrusion structure is formed by performing the curing through UV irradiation using a UV light source installed instead of the halogen heater 41.

Figure 16:
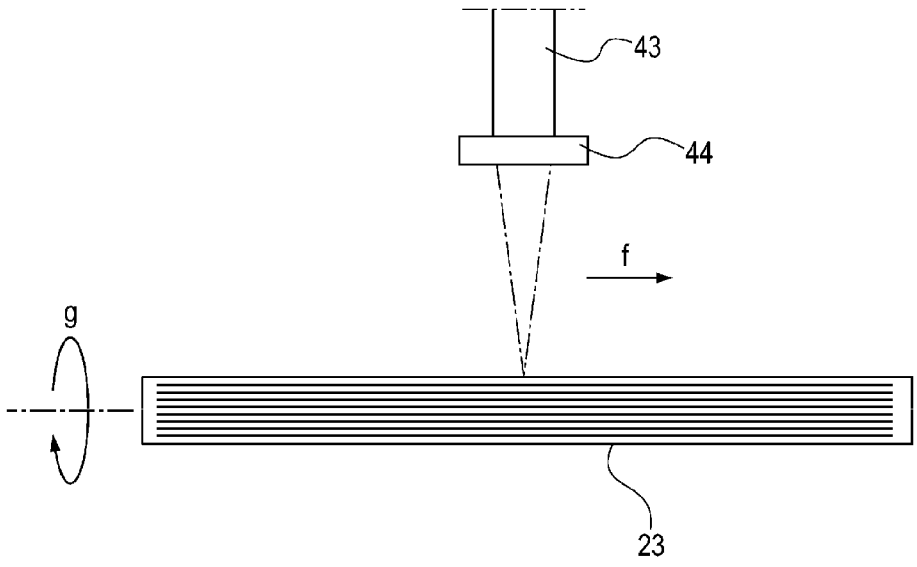
FIG. 16 is a schematic diagram illustrating another example of a method of forming the protrusion structure on the toner supplying member.

FIG. 16 is a schematic diagram illustrating another example of the method of forming the protrusion structure on the toner supplying member 23*a*. Herein, the method of forming the protrusion structure on the toner supplying member 23*a* by the laser edging method will be described.

The protrusion structure is formed on the outer layer surface of the toner supplying member 23 by scanning a laser 43 concentrated by a condensing lens 44 in the direction of the arrow f with respect to the toner supplying member 23. Next, the toner supplying member 23 is slightly rotated in the direction of the arrow g, and the protrusion structure is formed by scanning the laser again. The protrusion structure is formed in the axial direction on the circumferential surface of the toner supplying member by repeating the above-described manipulations.

(Method of Measuring Protrusion Structure)

Measurement of the protrusion structure on the toner supplying member 23 is performed by using an AFM (Nano-I manufactured by Pacific Nanotechnology) in accordance with the operation manual of the measurement apparatus. In this case, sampling is performed by cutting the outer layer surface of the developing roll by using a cutter, a laser, or the like to produce a smooth sheet.

Figure 17:
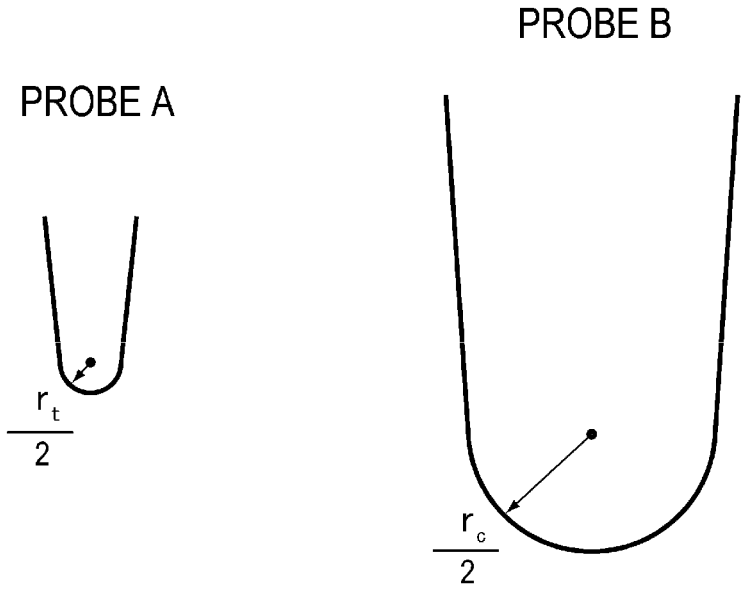
FIG. 17 is a schematic diagram illustrating topologies of two types of cantilever tips (probes) used in the measurement of the embodiment.

FIG. 17 is a schematic diagram illustrating topologies of two types of cantilever tips (probes) used in the measurement of the embodiment.

A probe A is a hemispherical probe the tip of which has a toner particle diameter $r_t$, and a probe B is a hemispherical probe the tip of which has a carrier particle diameter $r_c$.

Detailed measurement method will be described. First, the topology (x, y, $z_B$) of the outer layer surface of the toner supplying member is measured by using the probe B. The topology represents a topology of the outer layer surface of the toner supplying member which can be in contact with the magnetic carrier having a particle diameter $r_c$ and becomes a reference surface. Subsequently, at the same position, the topology $(x, y, z_A)$ is measured similarly by using the probe A. The topology represents a topology of the outer layer surface of the toner supplying member which can be in contact with the toner having a particle diameter $r_t$. A difference $(|z_B-z_A|)$ of the measured topologies in the height direction, that is, the height D from the reference surface is measured, so that coordinates (x, y) satisfying $r_{t10}/2 \leq D=|z_B-z_A| \geq r_t$ is extracted. By taking into consideration the topologies of the probes, an image process is performed with respect to the extracted coordinates by applying circles having a diameter $r_t$ with the coordinates being set as the centers.

Figure 18:
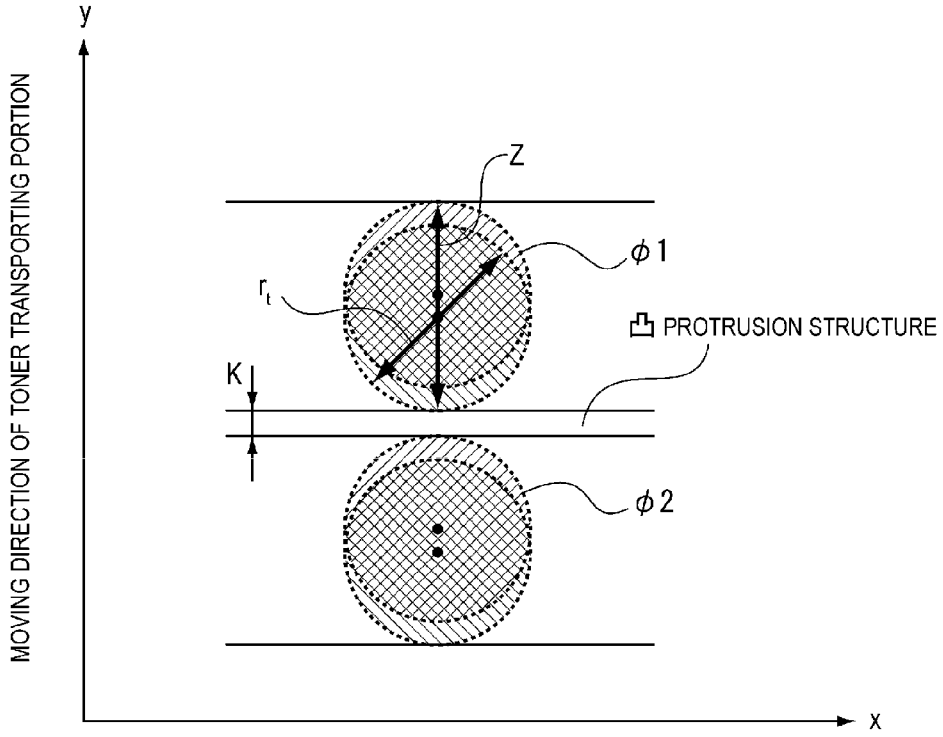
FIG. 18 is a diagram illustrating a result of measurement and an image process performed in the case of scanning the probe in the y axis when a moving direction of the toner supplying member is set as the y axis.

FIG. 18 is a diagram illustrating a result of the measurement and the image process in the case of scanning the probe in the y axis when the moving direction of the toner supplying member 23*a* is set as the y axis.

With respect to the extracted coordinates, an area ϕ covered by the overlapping circles, each having a diameter $r_t$, with the coordinates being set as the centers and an aperture width Z which is the long diameter of the area ϕ can be obtained. In addition, the space between the adjacent areas ϕ1 and ϕ2 is the protrusion structure of the embodiment, and the shortest distance therebetween, that is, a width K can be obtained. In addition, the protrusion structure of the embodiment is a structure which is obtained by the measurement and the image process. In other words, with respect to a structure having a short period where the probe A cannot enter or a structure having a long period where the probe B can enter, these structures do not influence the problem of the present invention, and these structures may also be included in the outer layer surface of the toner supplying member. In addition, in the actual case, even an incomplete protrusion structure of which micro area is partially damaged is considered to be the protrusion structure of the embodiment if the incomplete protrusion structure is determined to be a protrusion structure by the measurement.

(Method of Measuring Particle Size Distribution)

A particle size distribution of the toners is measured by using Coulter Multisizer III (manufactured by Beckman Coulter, Inc.) in accordance with the operation manual of the measurement apparatus. More specifically, 100 ml of an electrolyte solution (ISOTON) is added with a 0.1 g of surfactant as a dispersing agent and further added with a 5 mg of measurement sample (toner). The measurement sample is obtained by performing dispersion treatment on the electrolytic solution where the specimen is suspended with the use of the ultrasonic disperser for about 2 minutes.

An aperture of 100 μm is used as the aperture. A median diameter d50 is calculated by measuring the number of samples for each channel, and the median diameter d50 is defined as a number-average particle diameter $r_t$ of the sample.

A particle size distribution of the magnetic carriers is measured by a laser diffraction particle size distribution analyzer SALD-3000 (manufactured by Shimadzu Corporation) in accordance with the operation manual of the measurement apparatus. More specifically, a 0.1 g of magnetic carrier is introduced into the apparatus, and the measurement is performed. A median diameter d50 is calculated by measuring the number of samples for each channel, and the median diameter d50 is defined as a number-average particle diameter $r_c$.

(Method of Determining Triboelectric Series)

Only the magnetic carrier is introduced into the developer container 21 of the developing device 20 excluding the developing roll 25, and a normal developing operation is performed for about 1 minute. At this time, the voltage applying unit is removed, so that the toner supplying member 23 and the carrier recovering member 27 are in an electrically floated state. A probe of a surface voltmeter MODEL347 (manufactured by Trek) is installed so as to face the toner supplying member 23 at the position of the toner supplying portion U which is a facing portion, and a surface potential is measured. A potential difference (after-operation potential−before-operation potential) of potentials before and after the developing operation is measured. If the potential difference is positive, it is determined that the toner supplying member 23*a* is closer to the positive side in the triboelectric series than the magnetic carrier. If the potential difference is negative, it is determined that the toner supplying member 23*a* is closer to the negative side in the triboelectric series than the magnetic carrier.

Since it can be determined by frictional charging between the magnetic carrier and the toner whether the toner is closer to the positive side or the negative side than the magnetic carrier, a relative triboelectric series of a third party can be determined.

(Coat Evaluation Method)

A coat amount is obtained by absorbing the toner which coats the developing roll 25, measuring the weight (mg) and the area ($cm^2$) of the absorbed portion, and calculating the weight ($mg/cm^2$) per unit area as a quotient thereof.

A coat ratio is calculated from an image which is captured by imaging the developing roll 25 coated with the toner by a microscope (VHX-5000 manufactured by Keyence). Only the area (px) of the toner portion is extracted from the captured image by using image processing software (Photoshop manufactured by Adobe Inc.), and a ratio to the entire area is calculated as the coat ratio.

The density evaluation after fixing is a result obtained by coating the developing roll 25 with the toner, sequentially performing developing and transferring, fixing a toner image on a coat sheet, and performing density evaluation. In the density evaluation, a reflection density Dr on the coat sheet is measured by using a reflection densitometer (500 Series manufactured by X-Rite Co., Ltd.). The case where the reflection density does not reach a desired reflection density (CMY: Dr≥1.3, K: Dr≥1.5) is indicated by x, and the case where the reflection density reaches the desired reflection density is indicated by ○.

Second Embodiment

Figure 19:
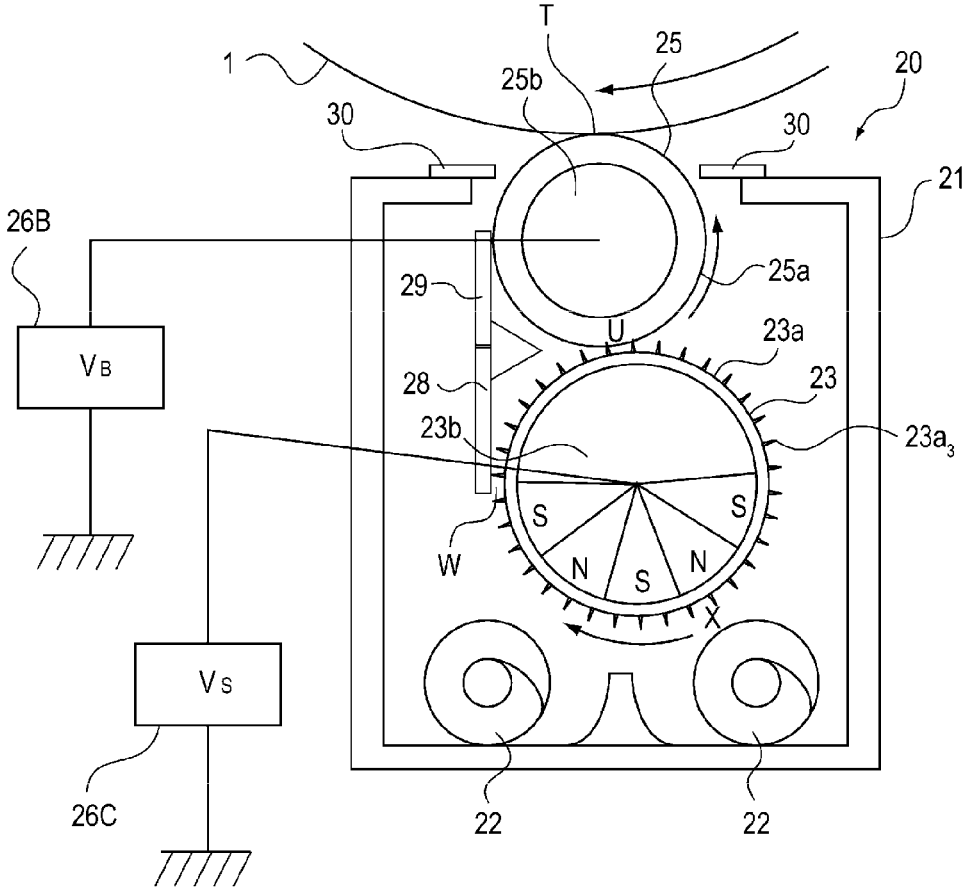
FIG. 19 is a schematic diagram illustrating another embodiment of the developing device according to the present invention.

FIG. 19 is a schematic diagram illustrating another embodiment of a developing device according to the present invention.

(Configuration of Developing Device)

A toner supplying member 23 is configured to include a toner supplying member 23*a* which is rotatable in the arrow direction of FIG. 19 and a permanent magnet 23*b* which is arranged to be fixed inside thereof. In the toner supplying member 23*a*, a protrusion structure where a plurality of protrusion portions $\mathbf{23}a_3$ are regularly aligned in the moving direction is formed, and a height of the protrusion portion $\mathbf{23}a_3$ is equal to or lower than a toner particle diameter. In addition, an aperture width between adjacent protrusion portions $\mathbf{23}a_3$ is equal to or larger than the toner particle diameter and smaller than a carrier particle diameter. In the embodiment, an aluminum roll is used as the toner supplying member 23*a*, and the protrusion structure having the same shape as that of the above-described first embodiment is formed on the aluminum roll by a laser edging method.

A developer supplying portion is configured to include a stirring/supplying member 22 which stirs and supplies a developer in a developer container 21. In addition, a carrier recovering member is configured to include a magnetic member 28 which is arranged to be fixed at a position facing the toner supplying member 23*a*. The magnetic member 28 is arranged at a position which is upstream from the toner supplying portion and downstream from the developer supplying portion which supplies the developer by the stirring/supplying member in the moving direction of the toner supplying member 23*a*.

In addition, a developing roll 25 is configured to include an elastic layer 25*a* and a base layer 25*b* and is arranged to be in contact with the toner supplying member 23 in a toner supplying portion U which is a facing portion. In an aperture of the developer container, a scattering prevention sheet 30 is installed in order to prevent the toner from scattering outside the developing device.

(Toner Coating Process)

Next, a process of coating the developing roll 25 with the toner will be described.

The developer which is supplied to the toner supplying member in the developer supplying portion X by the stirring/supplying member 22 is transported in the arrow direction of FIG. 19 by the rotation of the toner supplying member 23*a* and the magnetic force exerted by the magnetic field generated by the permanent magnet 23*b*. The transported developer is restrained in the recovering portion W between the magnetic member 28 and the toner supplying member 23 by the magnetic force exerted by the magnetic field generated in cooperation with the magnetic member 28 and the permanent magnet 23*b*, and finally, the developer is caused to fall down in the developer container 21 by gravity.

Since the toner which is in contact with the toner supplying member 23*a* to coat is not restrained by the magnetic force, the toner passes through the recovering portion W to be transported up to the toner supplying portion U which is the facing portion with respect to the developing roll 25.

A voltage is applied between the toner supplying member 23 and the developing roll 25 by voltage applying unit 26S and 26B. In addition, the moving velocity ratio $v_{23}/v_{25}$ of the toner supplying member 23*a* to the moving velocity $v_{25}$ of the developing roll 25 is set so as to satisfy Equation (5) or Equation (6).

Therefore, it is possible to form a coat on the developing roll 25 with the toner particles stably at a high density, so that it is possible to obtain a desired density even with a small toner amount and to improve density irregularity.

In addition, a cleaning member 29 is arranged to be in contact with the developing roll 25 at the position which is upstream from the toner supplying portion U and downstream from the developing portion T in the moving direction of the developing roll 25, so that the residual toner after the developing is recovered, and it is possible to prevent the occurrence of ghost images (by development history).

In the developing device of the embodiment, since the carrier recovering member has a simple structure, it is possible to cope with miniaturization of the developing device.

Third Embodiment

Figure 20:
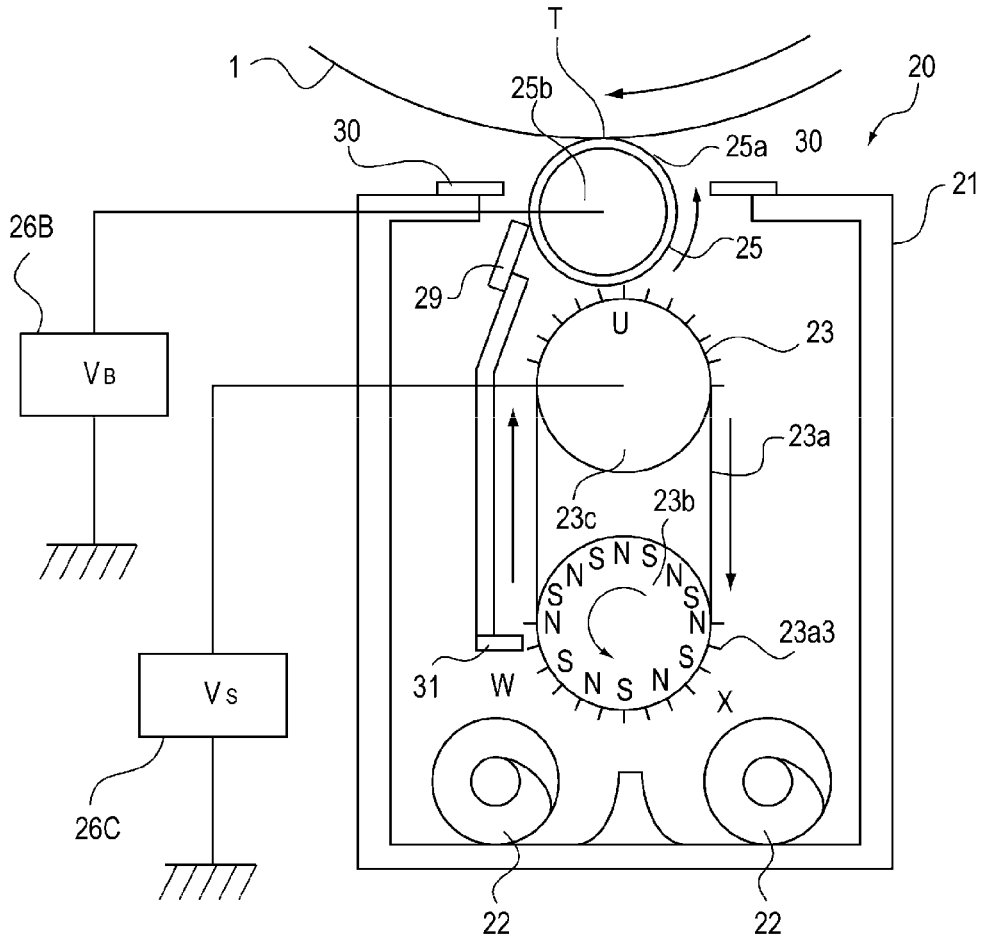
FIG. 20 is a schematic diagram illustrating another embodiment of the developing device according to the present invention.

FIG. 20 is a schematic diagram illustrating another embodiment of the developing device according to the present invention.

(Configuration of Developing Device)

A toner supplying member 23 is configured to include a rotatable permanent magnet 23*b*, a transporting roll 23*c*, and a toner supplying member 23*a* having an endless shape which is wound around the rotatable permanent magnet and the transporting roll to be circulatable in the arrow direction of FIG. 20. The permanent magnet 23*b* which is a magnetic member is arranged inside a circulation path where the toner supplying member 23*a* having an endless shape circulates. Any material having conductivity and rigidity may be used for the transporting roll 23*c*, and SUS, iron, aluminum, or the like may be used to form the transporting roll. In the toner supplying member 23*a*, a protrusion structure where a plurality of protrusion portions $23a_3$ are regularly aligned in the moving direction is formed, and a height of the protrusion portion $23a_3$ is equal to or smaller than a toner particle diameter. In addition, an aperture width between the adjacent protrusion portions $23a_3$ is equal to or larger than the toner particle diameter and smaller than a carrier particle diameter.

In the embodiment, a polyimide belt member is used as the toner supplying member 23*a*, and the protrusion structure having the same shape as that of the above-described first embodiment is formed on the belt member by a thermal nanoimprinting method.

A developer supplying portion is configured to include a stirring/supplying member 22 which stirs and supplies the developer in a developer container 21. In addition, a carrier recovering member is configured to include a regulating member 31 which is arranged to be fixed at a position where the regulating member and the toner supplying member 23*a* face each other. The regulating member 31 is arranged at a position which is upstream from the toner supplying portion and downstream from the developer supplying portion where the developer is supplied by the stirring/supplying member in the moving direction of the toner supplying member 23*a*. In addition, it is preferable that the regulating member 31 is formed by using a metal material having high permeability such as iron.

A developing roll 25 is configured to include an elastic layer 25*a* and a base layer 25*b* and is arranged to be in contact with the toner supplying member 23 in a toner supplying portion U which is a facing portion. In an aperture of the developer container, a scattering prevention sheet 30 is installed in order to prevent the toner from scattering outside the developing device.

(Toner Coating Process)

Next, a process of coating the developing roll 25 with the toner will be described.

The developer which is supplied to the toner supplying member in the developer supplying portion X by the stirring/supplying member 22 is transported in the arrow direction of FIG. 20 by the rotation of the toner supplying member 23*a* and the magnetic force exerted by the magnetic field generated by the rotation of the permanent magnet 23*b*. The transported developer is restrained in the recovering portion W between the regulating member 31 and the toner supplying member 23 by the magnetic force exerted by the magnetic field generated in cooperation with the regulating member 31 and the permanent magnet 23*b*, and finally, the developer is caused to fall down in the developer container 21 by gravity.

Since the toner which is in contact with the toner supplying member 23*a* to coat is not restricted by the magnetic force, the toner passes through the recovering portion W to be transported up to the toner supplying portion U which is the facing portion with respect to the developing roll 25.

A voltage is applied between the toner supplying member 23 and the developing roll 25 by voltage applying unit 26S and 26B. In addition, the moving velocity ratio $v_{23}/v_{25}$ of the toner supplying member 23*a* to the moving velocity $v_{25}$ of the developing roll 25 is set so as to satisfy Equation (5) or Equation (6).

Therefore, it is possible to form a coat on the developing roll 25 with the toner particles stably at a high density, so that it is possible to obtain a desired density even with a small toner amount and to improve density irregularity.

In addition, the cleaning member is arranged to be in contact with the developing roll 25 at the position which is upstream from the toner supplying portion U and downstream from the developing portion T in the moving direction of the developing roll 25, so that the residual toner after the developing is recovered, and it is possible to prevent the occurrence of ghost images (by development history).

In the developing device of the embodiment, the permanent magnet, which is arranged inside the toner supplying member 23*a* having an endless belt shape, is rotated, so that the magnetic brush is rotated and transported on the toner supplying member 23*a* so as to reverse the upper end and the lower end. Therefore, the contact frequency between the toner supplying member 23*a* and the toner is increased with a short transport distance and time. In addition, the rotation velocity of the permanent magnet is controlled, so that it is possible to suppress a change of the toner amount involved with the coat without influencing other configurations.

Fourth Embodiment

Figure 21:
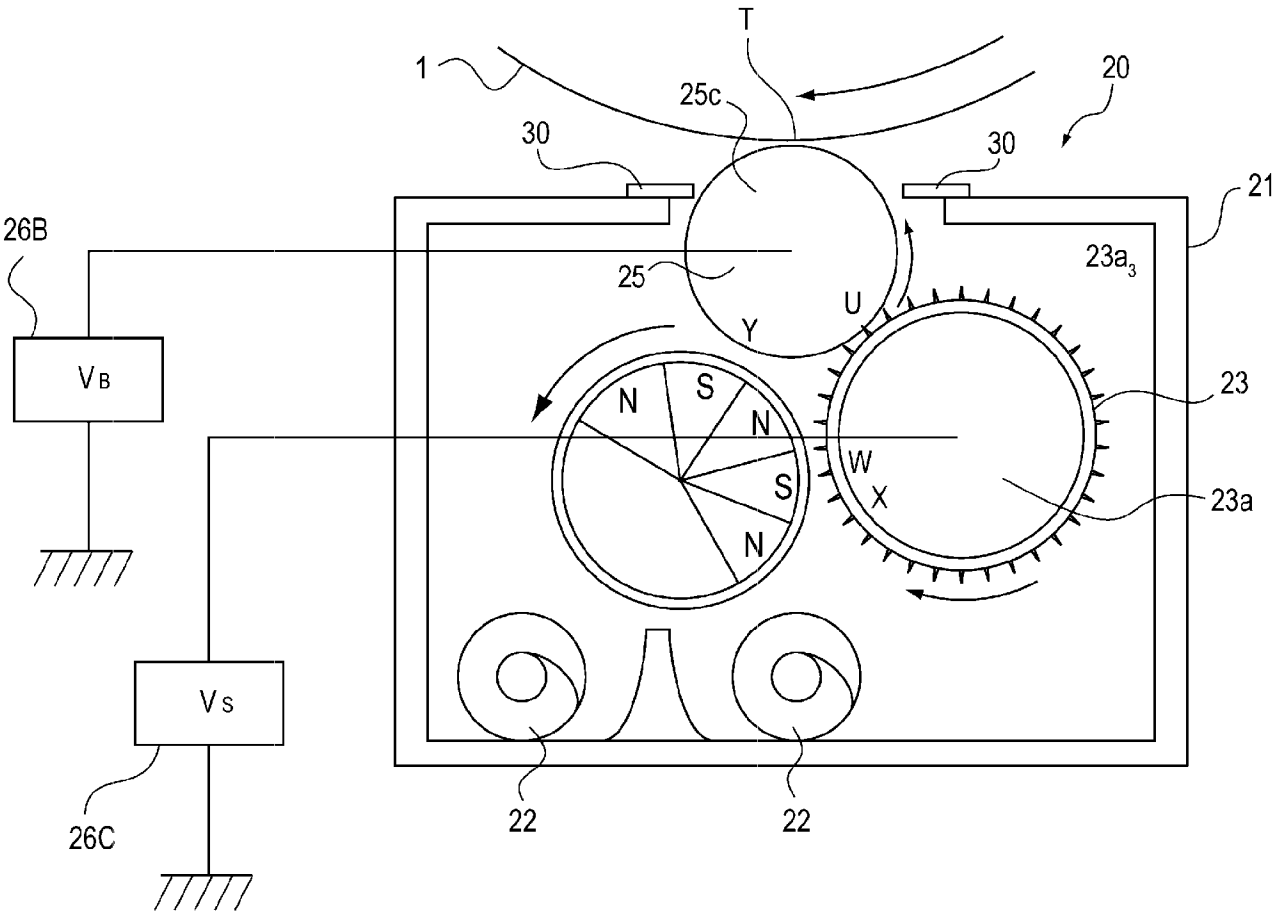
FIG. 21 is a schematic diagram illustrating another embodiment of the developing device according to the present invention.
Figure 22:
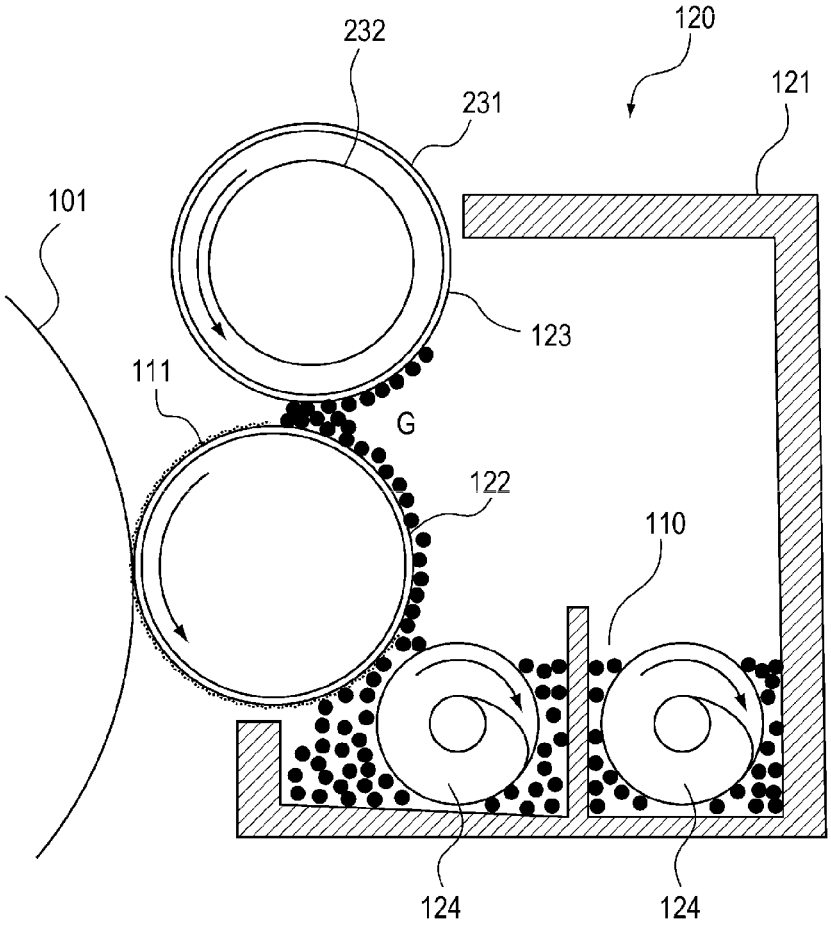
FIG. 22 is a diagram illustrating a developing device of the related art.
Figure 23:
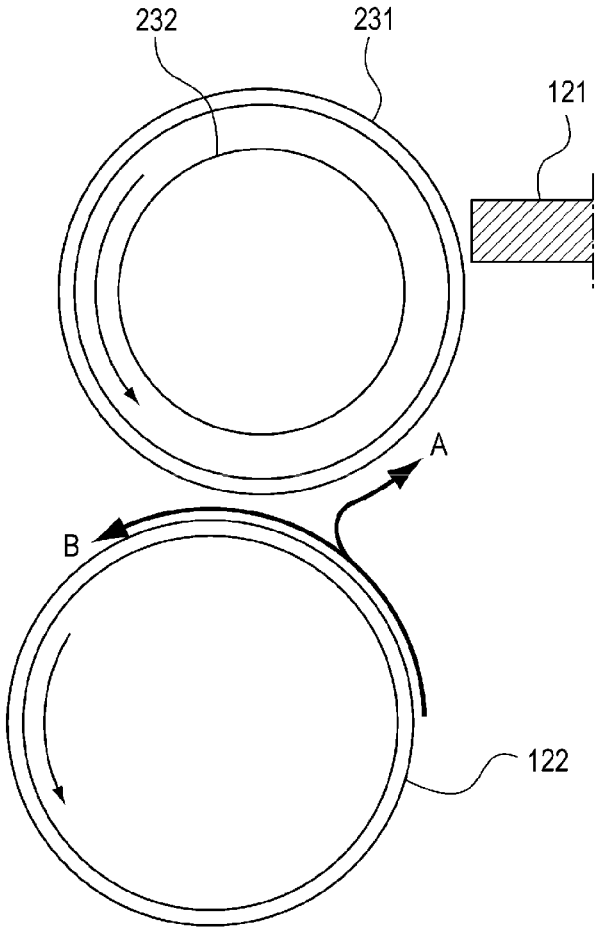
FIG. 23 is an enlarged diagram of a developer regulation region G.
Figure 24:
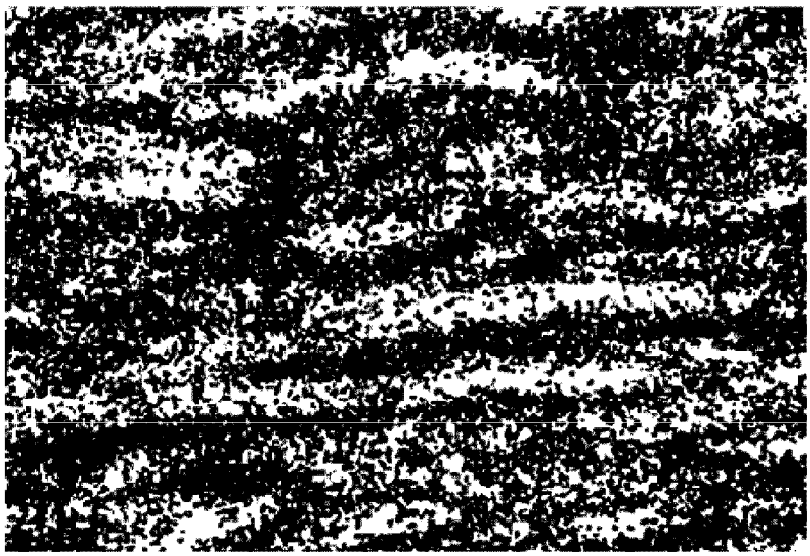
FIG. 24 is a diagram illustrating a toner layer obtained by the developing device of the related art where the developing roll is coated with the toner layer.
Figure 25A:
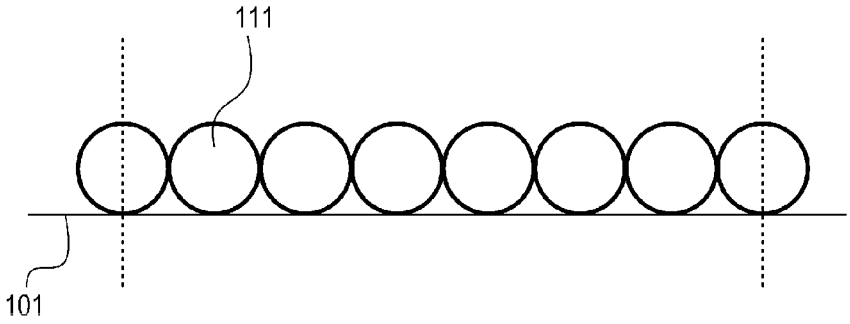
FIGS. 25A and 25B are schematic diagrams illustrating the case where a latent potential on a photosensitive member is developed by a toner.
Figure 25B:
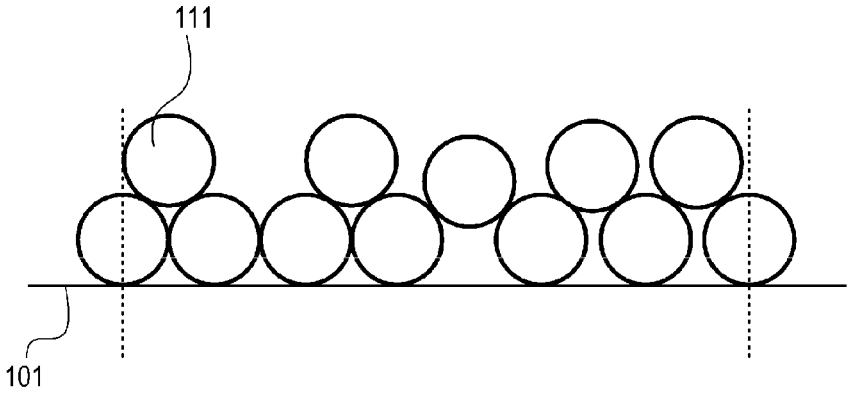
Figure 26:
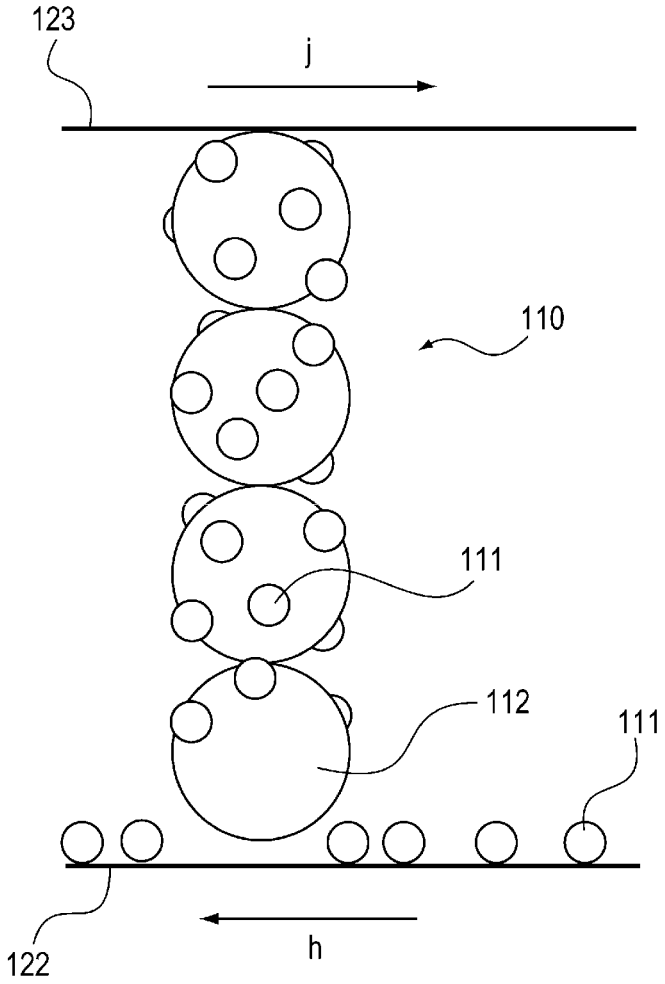
FIG. 26 is diagram illustrating a model investigated.
Figure 27A:
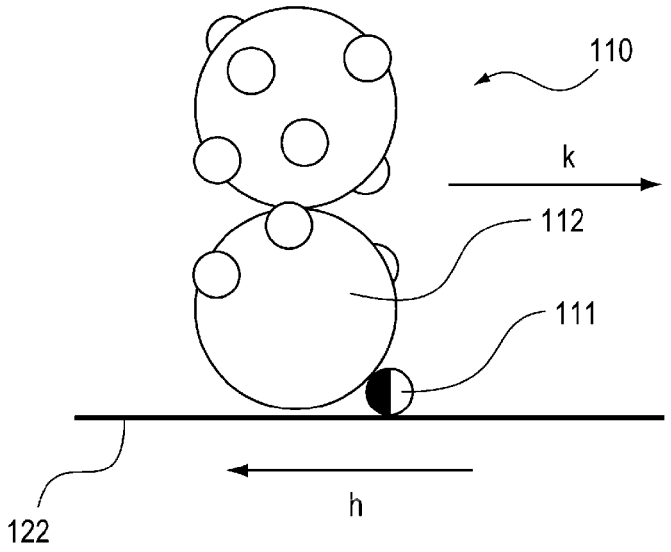
FIGS. 27A and 27B are schematic diagrams illustrating a state where the toner attached on the developing roll is recovered by a magnetic carrier of the developer.
Figure 27B:
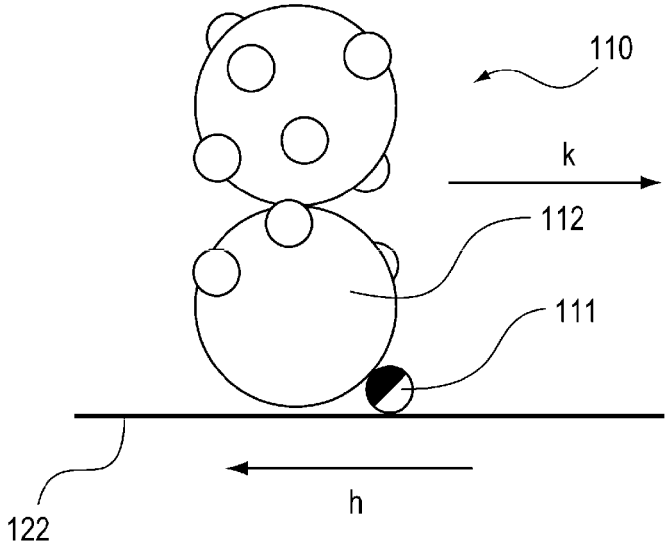

FIG. 21 is a schematic diagram illustrating another embodiment of the developing device according to the present invention.

(Configuration of Developing Device)

A toner supplying member 23 is configured to include a toner supplying member 23*a* which is rotatable in the arrow direction of FIG. 21. In the toner supplying member 23*a*, a protrusion structure where a plurality of protrusion portions $\mathbf{23}a_3$ are regularly aligned in the moving direction is formed, and a height of the protrusion portion $\mathbf{23}a_3$ is equal to or smaller than a toner particle diameter. In addition, an aperture width between adjacent protrusion portions $\mathbf{23}a_3$ is equal to or larger than the toner particle diameter and smaller than a carrier particle diameter.

In the embodiment, a rubber roll having an elastic layer is used as the toner supplying member 23*a*, and the protrusion structure having the same shape as that of the above-described first embodiment is formed by performing a thermal nanoimprinting method on the rubber roll.

A developer supplying/recovering member 32 which functions as a developer supplying portion and a carrier recovering member is configured to include a rotatable developer transporting portion 32*a* and a plurality of permanent magnets 32*b* which are arranged to be fixed inside thereof. The developer supplying/recovering member 32 is arranged so that the developer transported to the developer transporting portion 32*a* is in contact with the toner supplying member 23.

In addition, a developing roll 25 is configured to include an aluminum roll 25*c* and is arranged to be in contact with the toner supplying member 23 in the toner supplying portion U. In an aperture of the developer container, a scattering prevention sheet 30 is installed in order to prevent the toner from scattering outside the developing device.

(Toner Coating Process)

Next, the process of coating the developing roll 25 with the toner will be described.

The developer which is supplied to the developer supplying/recovering member 32 by the stirring/supplying member 22 is transported in the arrow direction of FIG. 21 by the rotation of the developer transporting portion 32*a* and the magnetic force exerted by the magnetic field generated by the permanent magnet 32*b*. The transported developer is in contact with the toner supplying member 23 in the developer supplying portion X and is recovered to the developer supplying/recovering member 32 in the recovering portion W by the magnetic force exerted by the magnetic field generated by the permanent magnet 32*b*.

Since the toner which is in contact with the toner supplying member 23*a* to coat is not restrained by the magnetic force, the toner passes through the recovering portion W to be transported up to the toner supplying portion U which is the facing portion with respect to the developing roll 25.

A voltage is applied between the toner supplying member 23 and the developing roll 25 by voltage applying unit 26S and 26B. In addition, the moving velocity ratio $v_{23}/v_{25}$ of the toner supplying member 23*a* to the moving velocity $v_{25}$ of the developing roll 25 is set so as to satisfy Equation (5) or Equation (6).

Therefore, it is possible to form a coat on the developing roll 25 with the toners stably at a high density, so that it is possible to obtain a desired density even with a small toner amount and to improve density irregularity.

(Developer Supplying/Recovering Member)

The developer supplying/recovering member 32 is arranged at a position which is upstream from the toner supplying portion U and downstream from the developing portion T in the moving direction of the developing roll 25 so that the developer recovered in the developer supplying/recovering member 32 is in contact with the developing roll 25. The supplying/recovering member 32 also functions as a cleaning member which recovers the residual toner after the developing, so that it is possible to prevent the occurrence of ghost images (by development history).

Hereinafter, the reason will be described. With respect to the two-component developer 8 recovered in the developer supplying/recovering member 32, since the coat of the toner is already formed in the toner supplying member 23*a*, the TD ratio is decreased. Therefore, the developer has a capability of recovering the toner and is in contact with the residual toner 10 which is not developed in the non-image portion Q, so that it is possible to recover the residual toner 10.

In the embodiment, although the developer supplying/recovering member 32 is not applied with a voltage and is in an electrically floated state, a voltage may be applied. In this case, in order to recover the residual toner 10 in the facing portion Y, it is preferable that the voltage applied to the developer supplying/recovering member 32 is set to be smaller than a DC voltage $V_B$ applied to the developing roll 25 (is set to be larger than $V_B$ in the case of using a negative-polarity toner). More preferably, the magnetic pole of the permanent magnet 32*b* arranged in the facing portion Y and the magnetic pole of the permanent magnet 32*b* arranged in the recovering portion W have the same polarity.

In the developing device according to the embodiment, the developer supplying/recovering member 32 may function as the developer supplying portion and the carrier recovering member. Therefore, there is no need to transport the developer between the members, and transport defects such as occurrence of non-moving layers hardly occurs during the transporting. Therefore, a shear force is hardly exerted on the developer, and it is possible to suppress deterioration in durability.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-024649, filed Feb. 12, 2014, which is hereby incorporated by reference herein in its entirety.

What is claimed is:

1. A developing device, for developing an electrostatic image formed on an image bearing member by a developer containing non-magnetic toner particles and magnetic carrier particles, comprising:

a developing member configured to carry toner particles and configured to develop the electrostatic image formed on the image bearing member;

a toner supplying member configured to transport the toner particles and configured to supply the toner particles to the developing member at a toner supplying portion; and a carrier recovering member configured to recover the magnetic carrier particles from the toner supplying member, the carrier recovering member being disposed to face the toner supplying member at an upstream position of the toner supplying member in a rotary direction of the toner supplying member and having a magnet to form a magnetic field between the magnet and the toner supplying member for collecting the magnetic carrier particles borne by the toner supplying member, wherein an outer surface of the toner supplying member includes a plurality of protrusion portions which extend along the outer surface of the toner supplying member in a direction intersecting a toner transporting direction of the toner supplying member and are aligned with a regular interval between adjacent protrusion portions, wherein the regular interval is equal to or larger than a particle diameter of a toner particle having an average particle diameter from among the particle diameters of the toner particles and smaller than a carrier particle diameter of a magnetic carrier particle having an average particle diameter from among the particle diameters of the magnetic carrier particles, and wherein the protrusion portions protrude from the remainder of the outer surface of the toner supplying member with a height that is smaller than the average particle diameter of the toner particles, and wherein the toner supplying member is disposed to contact the developing member at the toner supplying portion, and the toner supplying member and the developing member are movable so as to have a relative velocity difference in the toner supplying portion.

2. The developing device according to claim 1, wherein the following relationships are satisfied:

$$v_{23}/v_{25} \geq \lambda/r_t \text{ in a case of } r_t \leq Z < 2r_t; \text{ and}$$

$$v_{23}/v_{25} \geq (\lambda - r_t)/r_t \text{ in a case of } 2r_t \leq Z < r_c,$$

where a moving velocity of the outer layer surface of the toner supplying member is defined as $v_{23}$ (mm/s), a moving velocity of an outer layer surface of the developing member is defined as $v_{25}$ (mm/s), the average particle diameter of the toner particles is defined as $r_t$ (μm), the average particle diameter of the magnetic carrier particles is defined as $r_c$ (μm), the regular interval in the toner transporting direction between the adjacent protrusion portions is defined as Z (μm), and a period of an interval between the protrusion portions is defined as λ (μm).

3. The developing device according to claim 1, wherein the regular interval is smaller than three times the average particle diameter of the toner particles.

4. The developing device according to claim 1, wherein the following relationship is satisfied:

$$r_{t10}/2 \leq D \leq r_{t90}/2,$$

where the particle diameter of the toner particles of which cumulative number distribution is 10% in a toner particle size distribution is defined as $r_{t10}$ (μm), the particle diameter of the toner particles of which cumulative number distribution is 90% is defined as $r_{t90}$ (μm), and the height of the protrusion portions is defined as D (μm).

5. The developing device according to claim 1, wherein a triboelectric series of the outer layer surface of the toner supplying member, the toner particles, and the magnetic carrier is aligned so that the magnetic carrier particles are disposed between the toner particles and the outer layer surface of the toner supplying member.

6. The developing device according to claim 1, wherein the toner supplying member is rotatable and includes a magnetic member arranged inside thereof, wherein the carrier recovering member is configured to include a rotatable developer transporting portion and a magnetic member arranged inside the developer transporting portion and is arranged to be upstream from the toner supplying portion and downstream from a developer supplying portion where the developer is supplied to the toner supplying member in a rotational direction of the toner supplying member, and wherein a magnetic force of recovering the developer in the carrier recovering member is generated by the magnetic member arranged inside the toner supplying member and a magnetic member arranged inside the carrier recovering member.

7. The developing device according to claim 6, wherein the carrier recovering member is in contact with the developing member at a position which is upstream from the toner supplying portion and downstream from a developing portion where the toner is supplied from the developing member and the electrostatic image of the image bearing member is developed in a rotational direction of the developing member which is rotatable.

8. The developing device according to claim 1, wherein the toner supplying member is rotatable and includes a magnetic member arranged inside thereof, wherein the carrier recovering member is configured to include a magnetic member arranged at a position of facing the toner supplying member and is arranged to be upstream from the toner supplying portion and downstream from a developer supplying portion where the developer is supplied to the toner supplying member in a rotational direction of the toner supplying member, and wherein a magnetic force of recovering the developer in the carrier recovering member is generated by the magnetic member arranged inside the toner supplying member and the magnetic member arranged at the position of facing the toner supplying member.

9. The developing device according to claim 1, wherein the toner supplying member is rotatable and has an interior magnet, wherein the carrier recovering member is configured to include a regulating member which is arranged to be fixed at a position of facing the toner supplying member and is arranged to be upstream from the toner supplying portion and downstream from a developer supplying portion where the developer is supplied to the toner supplying member in a rotational direction of the toner supplying member, and wherein a magnetic force of recovering the developer in the carrier recovering member is generated by the magnet and the regulating member.

10. The developing device according to claim 9, wherein the toner supplying member is suspended on a rotatable transporting roll and the magnetic, and has a belt shape capable of circulating between the transporting roll and the magnetic.

11. The developing device according to claim 8, further comprising a cleaning member which removes a residual toner of the developing member after the developing of the electrostatic image which is formed on the image bearing member, wherein the cleaning member is arranged to be upstream from the developing member and downstream from a developing portion where the toner is supplied from the developing member, and the electrostatic image of the image bearing member is developed in a moving direction of the developing member.

12. The developing device according to claim 1, wherein the toner supplying member is rotatable, and wherein the carrier recovering member is configured to include a rotatable developer transporting portion and a magnetic arranged inside the developer transporting portion, and is supplied with the developer and allows the developer transported by the developer transporting portion to be in contact with the toner supplying member, so that the developer is supplied to the toner supplying member and the developer is recovered by a magnetic force of the magnetic.

13. The developing device according to claim 12, wherein the carrier recovering member is in contact with the developing member at a position which is upstream from the toner supplying portion and downstream from a developing portion where the toner is supplied from the developing member, and the electrostatic image of the image bearing member is developed in a rotational direction of the developing member.

14. The developing device according to claim 12, wherein the carrier recovering member also functions as a cleaning member which removes a residual toner of the developing member after the developing of the electrostatic image which is formed on the image bearing member.

15. The developing device according to claim 1, wherein the developing member is configured with a member having elasticity or flexibility and is arranged to be in contact with the image bearing member.

16. The developing device according to claim 1, wherein the developing member is configured with a conductive rigid member and is arranged not to be in contact with the image bearing member.

17. An image forming apparatus which forms an image by forming an electrostatic image on an image bearing member and developing the electrostatic image by a developing device, comprising the developing device according to claim 1.

* * * * *